US010588483B2

(12) United States Patent
Keller et al.

(10) Patent No.: US 10,588,483 B2
(45) Date of Patent: Mar. 17, 2020

(54) SINK ACCESSORY PART FOR ARRANGEMENT ON A SINK

(71) Applicant: BLANCO GmbH + Co KG, Oberderdingen (DE)

(72) Inventors: Josef Keller, Karlsruhe (DE); Christine Assmann, Neulingen (DE)

(73) Assignee: BLANCO GmbH + Co KG, Oberderdingen (DE)

( * ) Notice: Subject to any disclaimer, the term of this patent is extended or adjusted under 35 U.S.C. 154(b) by 0 days.

(21) Appl. No.: 15/385,422

(22) Filed: Dec. 20, 2016

(65) Prior Publication Data

US 2017/0172379 A1 Jun. 22, 2017

(30) Foreign Application Priority Data

Dec. 22, 2015 (DE) ..... 10 2015 122 606

(51) Int. Cl.
*A47L 19/02* (2006.01)
*E03C 1/186* (2019.01)
*E03C 1/18* (2006.01)

(52) U.S. Cl.
CPC ..... *A47L 19/02* (2013.01); *E03C 1/18* (2013.01); *E03C 1/186* (2013.01)

(58) Field of Classification Search
CPC ..... A47L 19/02; E03C 1/18
USPC ..... 4/637, 654, 656
See application file for complete search history.

(56) References Cited

U.S. PATENT DOCUMENTS 947,609 A * 1/1910 Betzold ..... 312/228
2015/0067962 A1* 3/2015 O'Brien ..... E03C 1/18 4/630
2017/0245693 A1* 8/2017 Palazzolo ..... E03C 1/186

FOREIGN PATENT DOCUMENTS

DE 201 17 890 4/2002
DE 102009016235 10/2010
WO 2006094816 9/2006

OTHER PUBLICATIONS

German Patent Office, Search Report issued in connection with German Application No. 10 2015 122 606.5, dated Feb. 13, 2017, 9 pages.
German Patent and Trademark Office, First Office Action, issued in connection with German Application No. 10 2015 122 606.5, dated May 9, 2019, 10 pages.

* cited by examiner

*Primary Examiner* — Christine J Skubinna
(74) *Attorney, Agent, or Firm* — Hanley, Flight & Zimmerman, LLC

(57) ABSTRACT

In order to provide a sink accessory part for arrangement on a sink, which can be positioned on the sink simply and stably without the need for a plurality of horizontal support areas at the same height on the sink, and without restricting the functionality of the sink accessory part or the sink, it is proposed that the sink accessory part should include a first coupling device, for coupling the sink accessory part to a first side wall of a bowl of the sink, and a second coupling device, for coupling the sink accessory part to a second side wall, opposing the first side wall, of the bowl of the sink.

20 Claims, 15 Drawing Sheets

SINK ACCESSORY PART FOR ARRANGEMENT ON A SINK

RELATED APPLICATION

The present disclosure relates to the subject matter disclosed in German Patent Application No. 10 2015 122 606.5 of Dec. 22, 2015, the entire specification of which is incorporated herein by reference.

FIELD OF DISCLOSURE

The present invention relates to a sink accessory part for arrangement on a sink, in particular a kitchen sink.

BACKGROUND

For the bowls of sinks, sink accessory parts such as a cutting board, a drip rack or a basin that can be suspended in the bowl from above are available.

Here, the sink accessory part is for example laid on the one hand on a tap ledge of the sink and on the other on a horizontal edge region of the bowl. For this, however, it is necessary for the front and rear support areas for the sink accessory part, in particular the tap ledge and the bowl edge region, to be at a single level in terms of height.

It is further known to lay a sink accessory part on horizontal support areas that are provided on steps in the side walls of the bowl. For this purpose, a complex shape of the relevant side walls of the bowl is required.

A sink accessory part may also be laid on a sink edge that runs around the bowl. For this purpose too, it is necessary for the sink edge to be at the same height everywhere.

Further, it is known to place a sink accessory part on a base region of the bowl of the sink. This results in low stability in the arrangement of the sink accessory part on the bowl, and restricted functionality of the sink accessory part and the bowl of the sink.

SUMMARY OF THE INVENTION

The object of the present invention is to provide a sink accessory part for arrangement on a sink, which can be positioned on the sink simply and stably without the need for a plurality of horizontal support areas at the same height on the sink, and without restricting the functionality of the sink accessory part or the sink.

This object is achieved according to the invention in the case of a sink accessory part having the features of the precharacterising clause of claim 1, in that the sink accessory part includes a first coupling device, for coupling the sink accessory part to a first side wall of a bowl of the sink, and a second coupling device, for coupling the sink accessory part to a second side wall, opposing the first side wall, of the bowl of the sink.

The present invention is based on the concept of laying the sink accessory part not on substantially horizontal support areas on the bowl, the region of the sink surrounding the bowl, or a worktop on which the sink is arranged, but directly on two mutually opposing side walls of the bowl that are preferably inclined to the vertical in the installed condition of the sink.

This provides the advantage that no steps with support areas for the sink accessory part have to be constructed on the relevant side walls of the sink.

The working height above the base region of the bowl, at which the sink accessory part is arranged in the position coupled to the bowl of the sink, may be determined merely from the configuration of the sink accessory part, in particular from the spacing between the first coupling device and the second coupling device of the sink accessory part.

It is thus readily possible to immobilise on the bowl of the sink two different sink accessory parts with different spacings between the first coupling device and the second coupling device at different working heights if these different sink accessory parts have different spacings between the first coupling device and the second coupling device, and if the first side wall and the second side wall of the bowl are inclined in relation to one another such that they have different spacings from one another in different positions in respect to height.

The sink accessory part according to the invention is at least partly inserted into the bowl, and is clamped between the first side wall and the second side wall, at a working height that is predetermined by the dimension of the sink accessory part in the longitudinal direction thereof.

In a preferred embodiment of the invention, it is provided for the first coupling device and/or the second coupling device to be couplable by positive locking and/or by force locking, in particular by frictional engagement, to the respectively associated side wall of the bowl.

For secure immobilisation of the sink accessory part on the bowl, it is favourable if the first coupling device and/or the second coupling device each include at least two, in particular in each case at least three, particularly preferably in each case at least four, mutually spaced coupling elements for coupling the sink accessory part to the respectively associated side wall of the bowl.

For particularly stable immobilisation of the sink accessory part on the bowl, it is advantageous if the first coupling device and/or the second coupling device each include at least two coupling elements that are arranged on the sink accessory part at different heights.

The first coupling device and/or the second coupling device preferably each include at least one coupling element that is arranged on a side face of the sink accessory part.

The first coupling device and/or the second coupling device preferably each include at least one coupling element that includes a friction-enhancing material, for example a plastics material, in particular an elastomer material.

In this case, the coupling element may be formed in particular substantially entirely from a friction-enhancing material, for example a plastics material, in particular an elastomer material.

As an alternative thereto, it may also be provided for the coupling element to be provided with a coating made from a friction-enhancing material, for example a plastics material, in particular an elastomer material.

This friction-enhancing coating is in that case preferably in contact with the respectively associated side wall of the bowl when the sink accessory part is in the position coupled to the bowl.

There are various possibilities for arranging the coupling element on a base body of the sink accessory part.

For example, it may be provided for the first coupling device and/or the second coupling device each to include at least one coupling element that surrounds an end region of a carrier element of the sink accessory part.

A carrier element of this kind may for example take the form of a longitudinal carrier or a transverse carrier of a base body of the sink accessory part.

As an alternative or in addition thereto, it may be provided for the first coupling device and/or the second coupling device each to include at least one coupling element that is at least partly received in a recess in the sink accessory part.

Preferably in this case, the coupling element projects beyond the respectively associated recess in the sink accessory part so that the projecting part of the coupling element can come into contact with the respectively associated side wall of the bowl in a simple manner.

So that the sink accessory part can be arranged on a horizontal supporting face when it is not in the position coupled to the bowl, it is favourable if the sink accessory part includes at least one support element for supporting the sink accessory part on a horizontal supporting face.

A support element of this kind preferably includes a friction-enhancing material, for example a plastics material, in particular an elastomer material.

For example, it may be provided for the support element to be formed substantially entirely from a friction-enhancing material, for example a plastics material, in particular an elastomer material.

As an alternative thereto, it may also be provided for the support element to be provided with a coating made from a friction-enhancing material, for example a plastics material, in particular an elastomer material.

A coating of this kind is in that case preferably in contact with the horizontal supporting face when the sink accessory part is supported on a horizontal supporting face of this kind.

The at least one support element may be different from the coupling elements of the sink accessory part. As an alternative thereto, it may also be provided for the at least one support element at the same time also to serve as a coupling element of a coupling device of the sink accessory part, by means of which the sink accessory part is couplable to a side wall of the bowl of the sink.

The sink accessory part may in principle have any desired function and shape.

In preferred embodiments of the invention, it is provided for the sink accessory part to take the form for example of a drip element, a cutting board, a basin and/or a grille.

The sink accessory part according to the invention is particularly suitable for use thereof for providing a support, preferably with a support area that is oriented substantially horizontally, on a bowl of a sink, wherein the sink accessory part is coupled by means of the first coupling device to a first side wall of the bowl and by means of the second coupling device to a second side wall of the bowl.

It is then possible to lay any desired articles, for example crockery items and/or cutlery items, on the support provided by the sink accessory part.

The sink accessory part according to the invention preferably forms a constituent part of a combination comprising a sink having at least one bowl and a sink accessory part of this kind, wherein the sink accessory part is couplable by means of the first coupling device to a first side wall of the bowl and by means of the second coupling device to a second side wall of the bowl.

Here, the sink preferably takes the form of a kitchen sink.

It is particularly favourable if the region of the first side wall and/or the region of the second side wall to which the sink accessory part is coupled in the coupled condition has/have a form that is substantially smooth and/or substantially planar and/or free of steps.

Further, it is preferably provided for the sink accessory part, when it is in a position coupled to the side walls of the bowl, not to be in contact with a bowl flange, bowl edge or bowl edge region of the sink that adjoins a side wall of the bowl.

Further, it is favourable if the sink accessory part, when it is in a position coupled to the side walls of the bowl, not to be in contact with a base region of the bowl of the sink.

In a preferred embodiment of the invention, it is provided for the sink accessory part, when it is in a position coupled to the side walls of the bowl, to be secured in a manner preventing movement in relation to the bowl.

Preferably, the sink accessory part, when it is in the position coupled to the side walls of the bowl, is secured in a manner preventing movement in relation to the bowl in the horizontal direction and/or in the vertical direction.

A securing of this kind of the sink accessory part in a manner preventing movement in relation to the bowl may in particular be performed by positive locking and/or by force locking.

This securing may in particular be achieved by frictional engagement between the first coupling device and the first side wall of the bowl, and/or by frictional engagement between the second coupling device and the second side wall of the bowl.

In a preferred embodiment of the invention, it is provided for the first side wall of the bowl and/or the second side wall of the bowl to be inclined to the vertical in the installed condition of the sink.

Here, the inclination of the respective side wall to the vertical is preferably at least approximately 1°, in particular at least approximately 3°, particularly preferably at least approximately 6°.

Further, it is preferably provided for the inclination of the relevant side wall of the bowl to the vertical to be at most approximately 20°, in particular at most approximately 10°, particularly preferably at most approximately 8°.

The sink accessory part according to the invention is preferably at least partly insertable into the bowl, and is clampable between a first side wall and a second side wall, opposing the first side wall, of the bowl at a desired height position in relation to the base of the bowl.

A fixed immobilisation or fixing of the sink accessory part to the bowl is achieved in that there is positive locking and/or force locking between the sink accessory part and the bowl.

For immobilisation of the sink accessory part on the bowl, no support areas, in particular no substantially horizontal support areas, are required on the bowl of the sink.

As a result of coupling the sink accessory part to the bowl by means of the coupling devices, secure, stable functioning of the sink accessory part on or in the bowl is ensured.

Immobilising the sink accessory part on the first side wall and on the second side wall may be achieved by means of contact faces on the sink accessory part, which are adapted to the inclination of the respective side wall.

When the sink accessory part is arranged on the bowl, the sink accessory part acts in the manner of a wedge and is clamped in the bowl.

On application of a slight releasing force, the sink accessory part can be released from the bowl again.

Here, the procedure of detaching the sink accessory part from the bowl may be assisted by an elastic deformation of the sink accessory part and/or an elastic deformation of the bowl.

Apart from when it is in the position coupled to the bowl, the sink accessory part may additionally also be used on a worktop, for example as a potholder, or on the base region of the bowl, for example as a rack.

The sink accessory part may be coupled to the bowl in various positions in relation to the bowl. In particular, it is possible to position the sink accessory part substantially centrally on the bowl.

However, it is also possible for the sink accessory part to be coupled to the bowl in a manner offset from a central position, for example offset to left or right.

An adjustment of the height position of the sink accessory part on the bowl is possible by altering the spacing between the first coupling device and the second coupling device without the need for alterations to the sink for this purpose.

When a sink accessory part is laid on steps on the side walls of the bowl, by contrast, the height position of these steps would have to be altered in order to enable the sink accessory part to be arranged on the bowl at a different height position.

By comparison with a sink accessory part that is set on the base of the bowl, the sink accessory part that is coupled to the side walls of the bowl can be put under greater load.

Moreover, it may be provided for the sink accessory part, when it is in the position coupled to the bowl, to have no play relative to the bowl but to be arranged immovably on the bowl and/or to be fixedly immobilised on the bowl.

The sink accessory part according to the invention may be shaped simply, flat and at low cost.

The inventive concept according to the invention may be carried over to all types of sink accessory parts.

The concept according to the invention offers a simple and low-cost alternative to concepts that use stepped side walls.

Further features and advantages of the invention form the subject of the description below and the illustrative representation of exemplary embodiments.

BRIEF DESCRIPTION OF THE DRAWINGS

Like or functionally equivalent elements are designated by the same reference numerals in all the Figures.

DETAILED DESCRIPTION OF THE INVENTION

Figure 1:
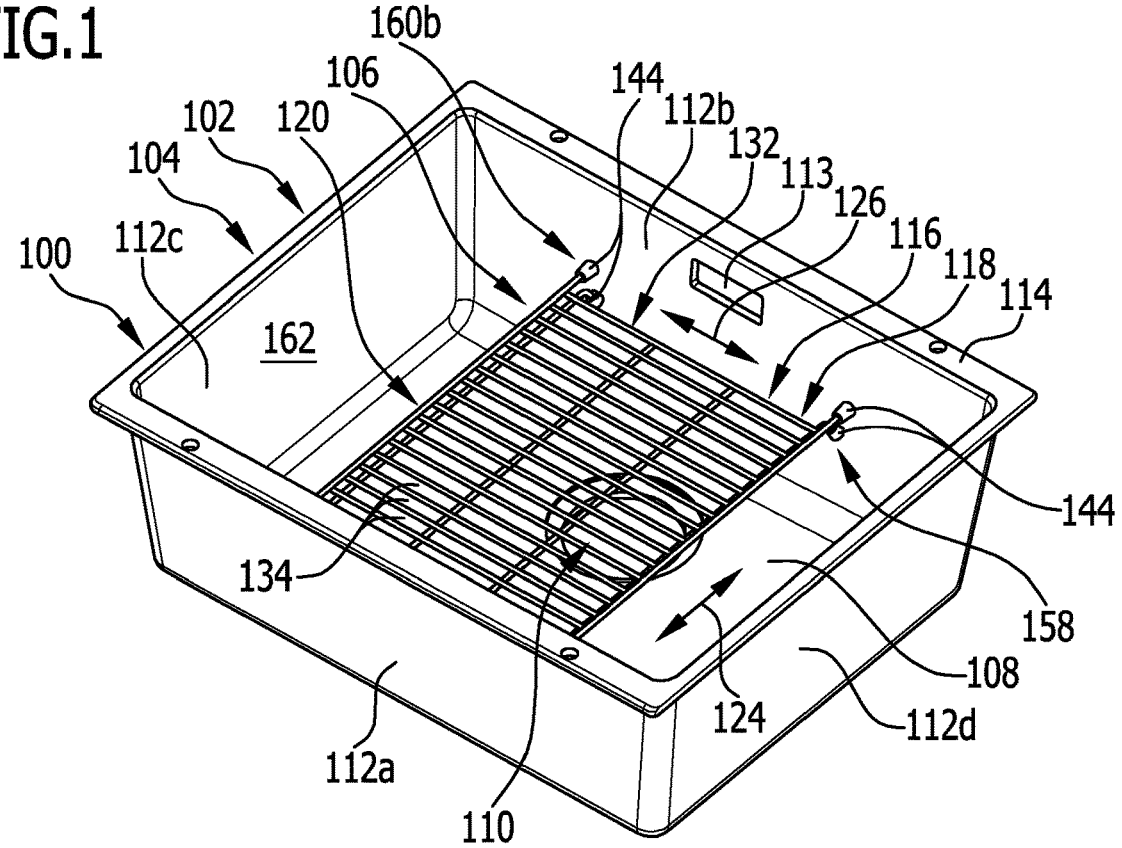
FIG. 1 shows a perspective illustration of a bowl of a sink, in particular a kitchen sink, having a sink accessory part that is arranged in the bowl and is in the form of a drip element that is coupled by a first coupling device to a first side wall of the bowl and by a second coupling device to a second side wall of the bowl, opposing the first side wall of the bowl.
Figure 2:
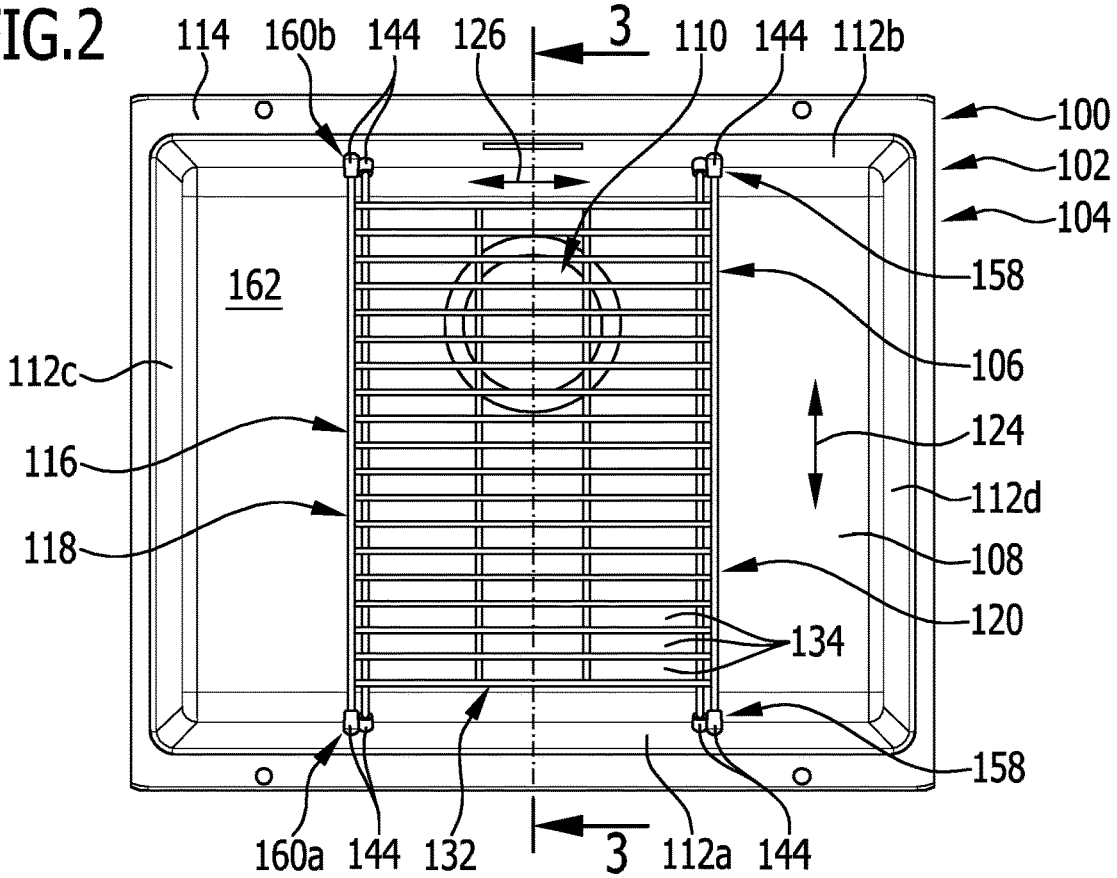
FIG. 2 shows a plan view from above of the combination comprising a sink and the sink accessory part in FIG. 1.
Figure 3:
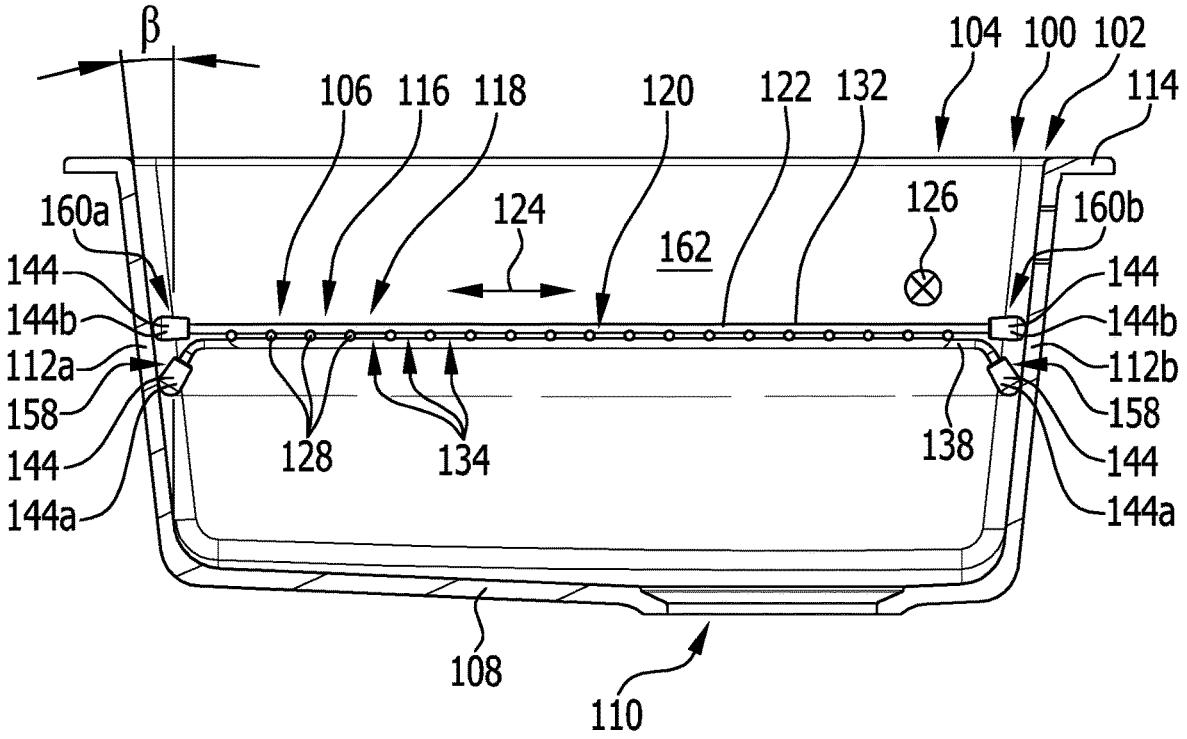
FIG. 3 shows a vertical section through the sink accessory part and the sink, along the line 3-3 in FIG. 2.

A combination that is illustrated in FIGS. 1 to 3 and designated 100 as a whole includes a sink 102 having a bowl, in this case illustrated by way of example as an undermount bowl, and a sink accessory part 106 that is arrangeable on the bowl 104.

Figure 4:
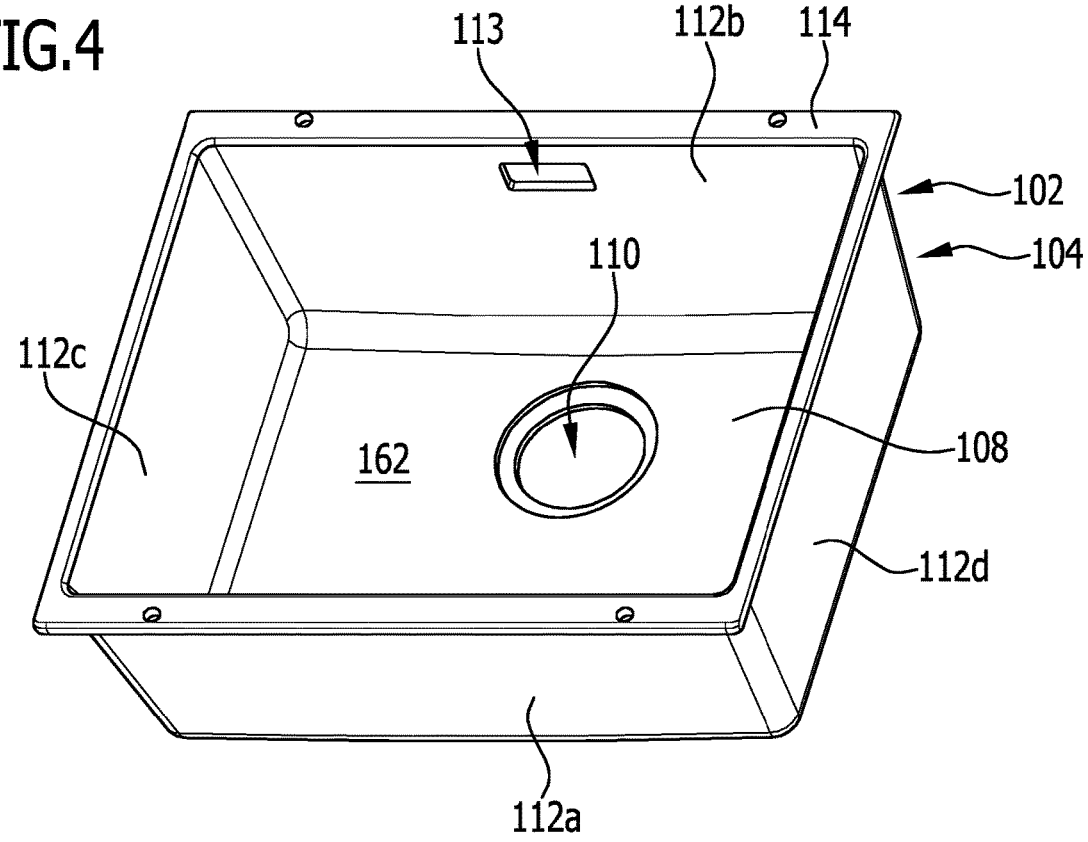
FIG. 4 shows a perspective illustration of the sink in FIG. 1, without the sink accessory part.
Figure 5:
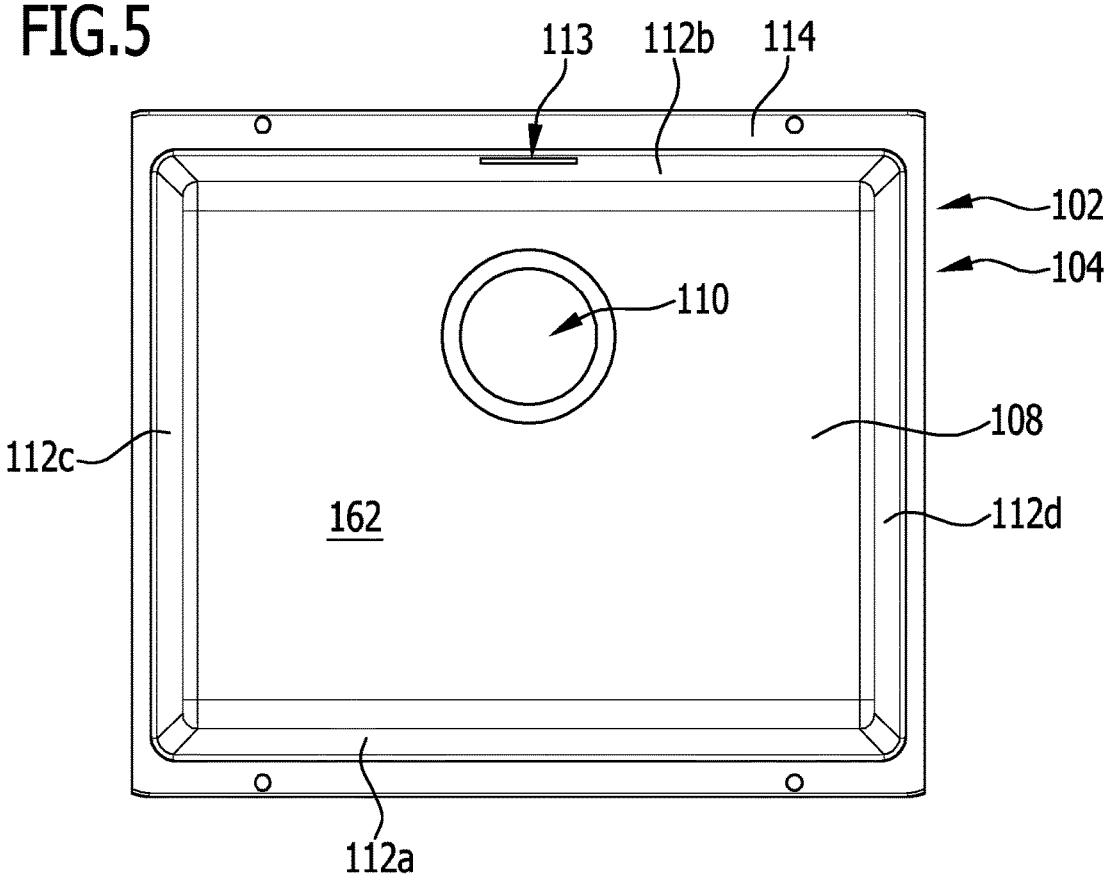
FIG. 5 shows a plan view from above of the sink in FIG. 4.

The bowl 104, which is illustrated individually in FIGS. 4 and 5, includes a base region 108, in which there is provided a bowl drainage opening 110, and side walls 112 that extend almost vertically upwards from the base region 108, in particular a front first side wall 112*a*, a rear second side wall 112*b*, which may be provided with an overflow opening 113, and a left-hand side wall 112*c* and a right-hand side wall 112*d*, which connect the first side wall 112*a* and the second side wall 112*b* to one another.

Further, the bowl 104 includes a bowl flange 114 that runs peripherally along the upper edges of the side walls 112 and is oriented substantially horizontally.

The bowl 104 is preferably made in one piece.

The bowl 104 may in principle be formed from any desired material, for example a stainless steel material, a ceramic material, a plastics material or a composite material.

The sink 102 may include, besides the at least one bowl 104, other bowls and/or a drip surface.

The sink accessory part 106, which is illustrated individually in FIGS. 6 to 13, is for example constructed as a drip element 116, in particular in the form of a drip rack 118.

In this embodiment, the sink accessory part 106 includes a base body 120 having two longitudinal carriers 122 that extend parallel to a longitudinal direction 124 of the sink accessory part 106 and parallel to one another, and are spaced from one another in a transverse direction 126 of the sink accessory part 106 that runs perpendicular to the longitudinal direction 124.

The two longitudinal carriers 122 are connected to one another by a plurality of transverse carriers 128 that extend substantially parallel to the transverse direction 126 and are spaced from one another in the longitudinal direction 124—preferably equidistantly.

Figure 6:
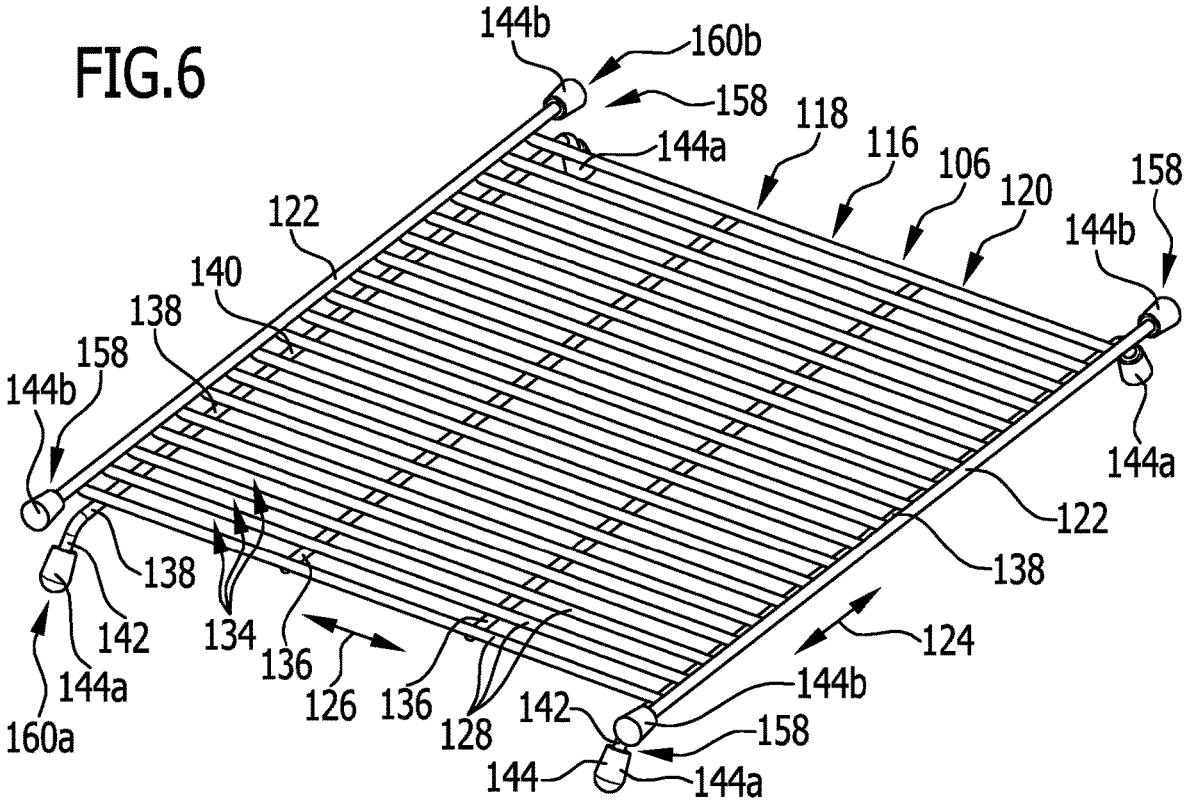
FIG. 6 shows a perspective illustration of the sink accessory part in FIG. 1.
Figure 7:
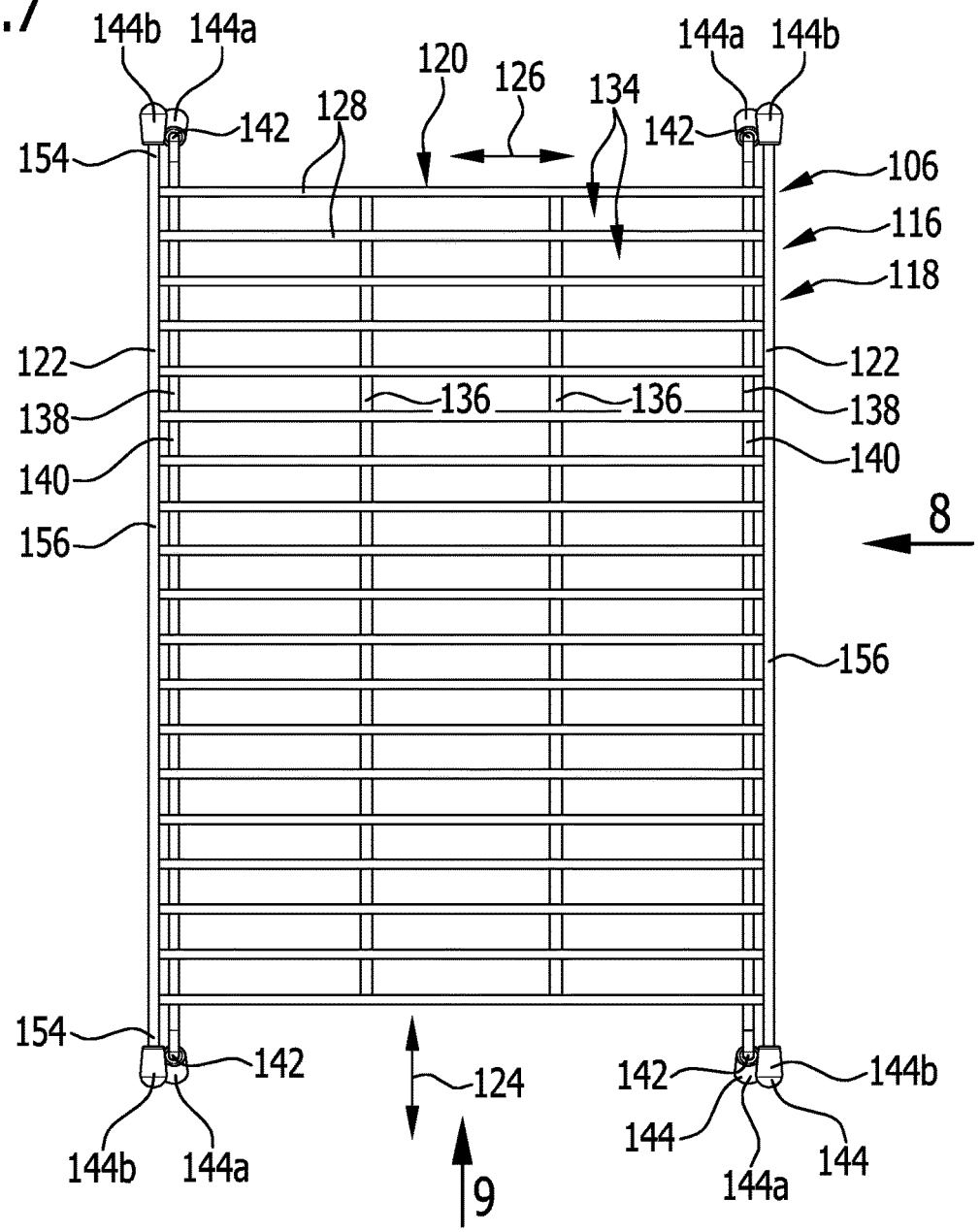
FIG. 7 shows a plan view from above of the sink accessory part in FIG. 6.

As can best be seen from FIG. 6, the transverse carriers 128 are preferably fixed in a lower region 130 of the upper longitudinal carriers 122.

The rounded tops of the transverse carriers 128 span a support area 132 of the sink accessory part 106 on which articles, for example crockery and/or cutlery, can be laid, for example after these articles have been washed up, in order to enable water to drain off these articles through the interstices 134 between the transverse carriers 128, which succeed one another in the longitudinal direction 124.

At the rounded bottoms of the transverse carriers 128, the latter are connected to one another by one or more inner lower longitudinal carriers 136, which preferably run parallel to the longitudinal direction 124.

Further, the transverse carriers 128 are connected to one another at their rounded bottoms by two outer lower longitudinal carriers 138, which, in a central region 140, extend parallel to the longitudinal direction 124 of the sink accessory part 106.

Figure 8:
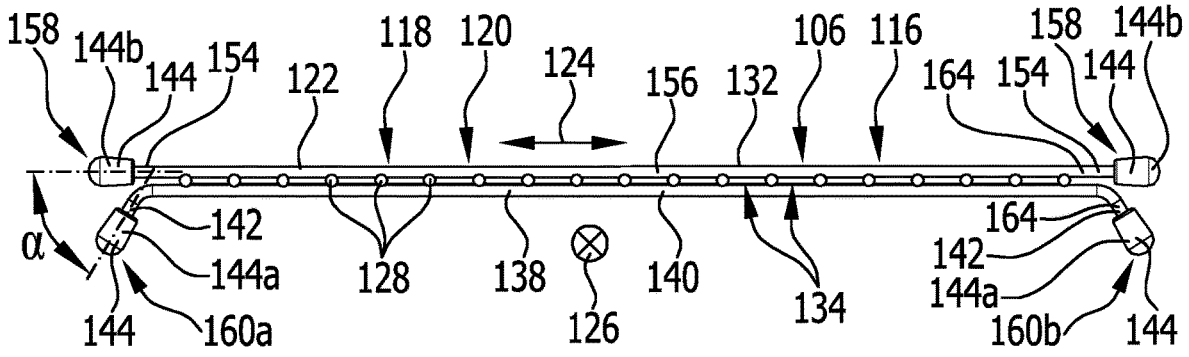
FIG. 8 shows a side view of the sink accessory part in FIGS. 6 and 7, with the direction of view in the direction of the arrow 8 in FIG. 7.
Figure 9:
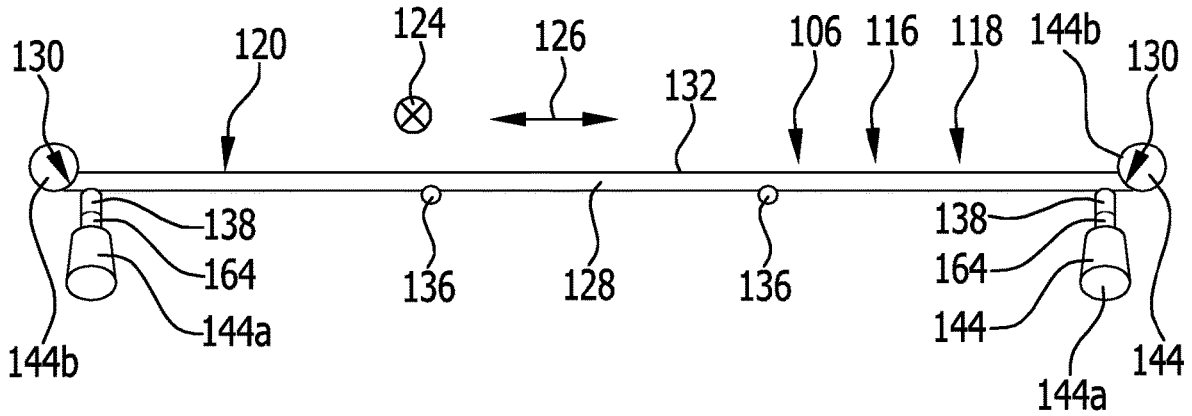
FIG. 9 shows a front view of the sink accessory part in FIGS. 6 to 8, with the direction of view in the direction of the arrow 9 in FIG. 7.
Figure 10:
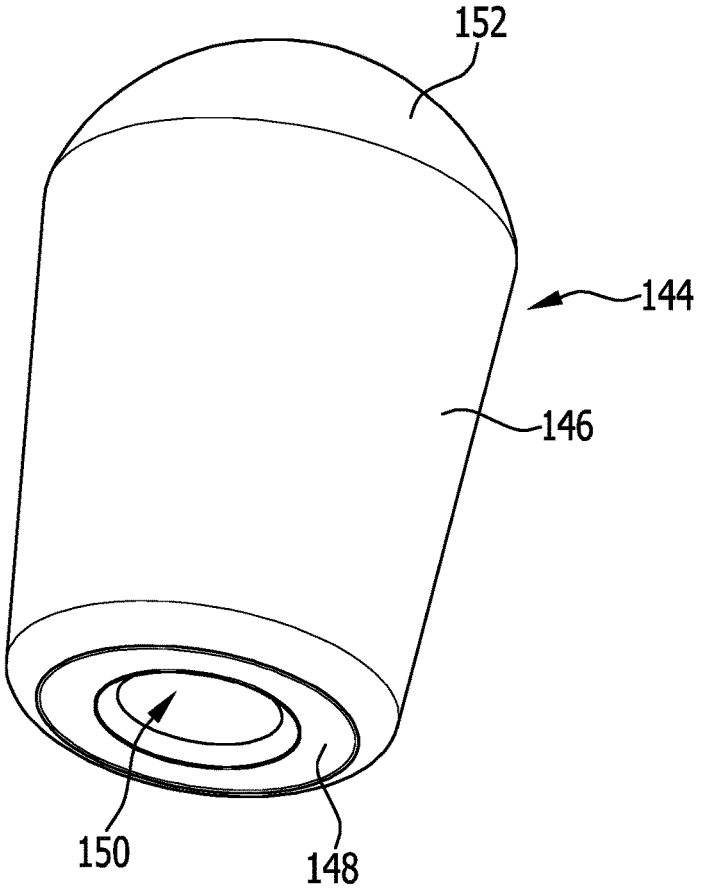
FIG. 10 shows a perspective illustration of a coupling element of a coupling device of the sink accessory part in FIGS. 6 to 9.
Figure 11:
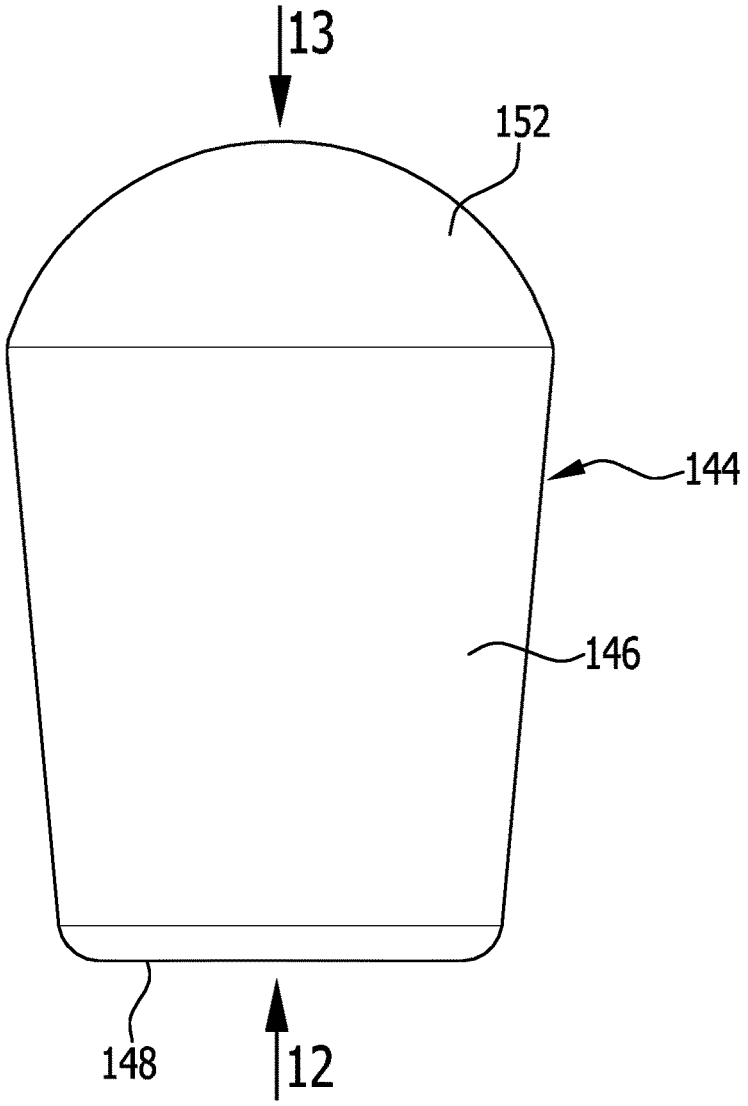
FIG. 11 shows a side view of the coupling element in FIG. 10.
Figure 12:
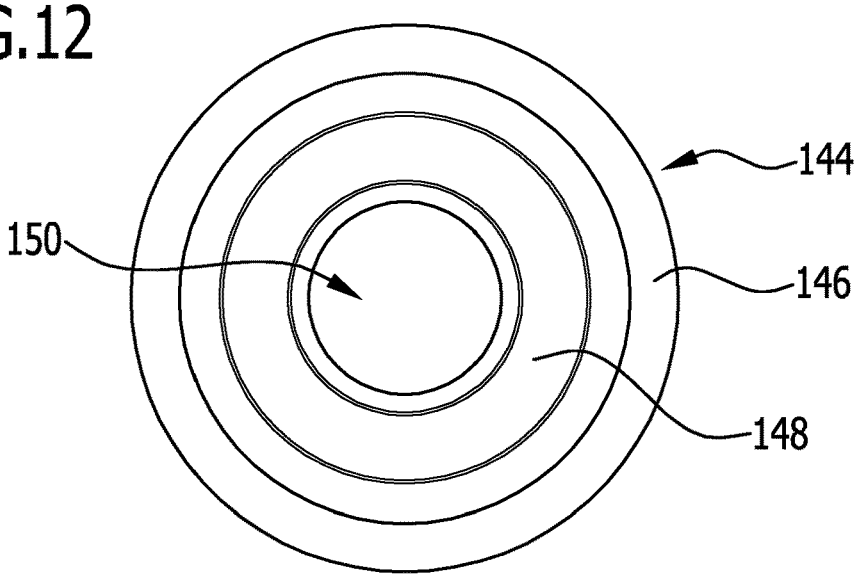
FIG. 12 shows a plan view from below of the coupling element in FIGS. 10 and 11, with the direction of view in the direction of the arrow 12 in FIG. 11.
Figure 13:
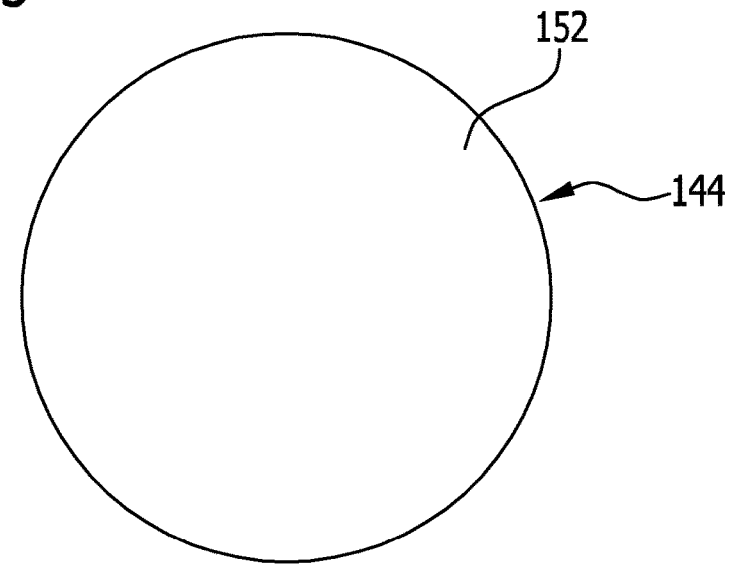
FIG. 13 shows a plan view from above of the coupling element in FIGS. 10 to 12, with the direction of view in the direction of the arrow 13 in FIG. 11.
Figure 14:
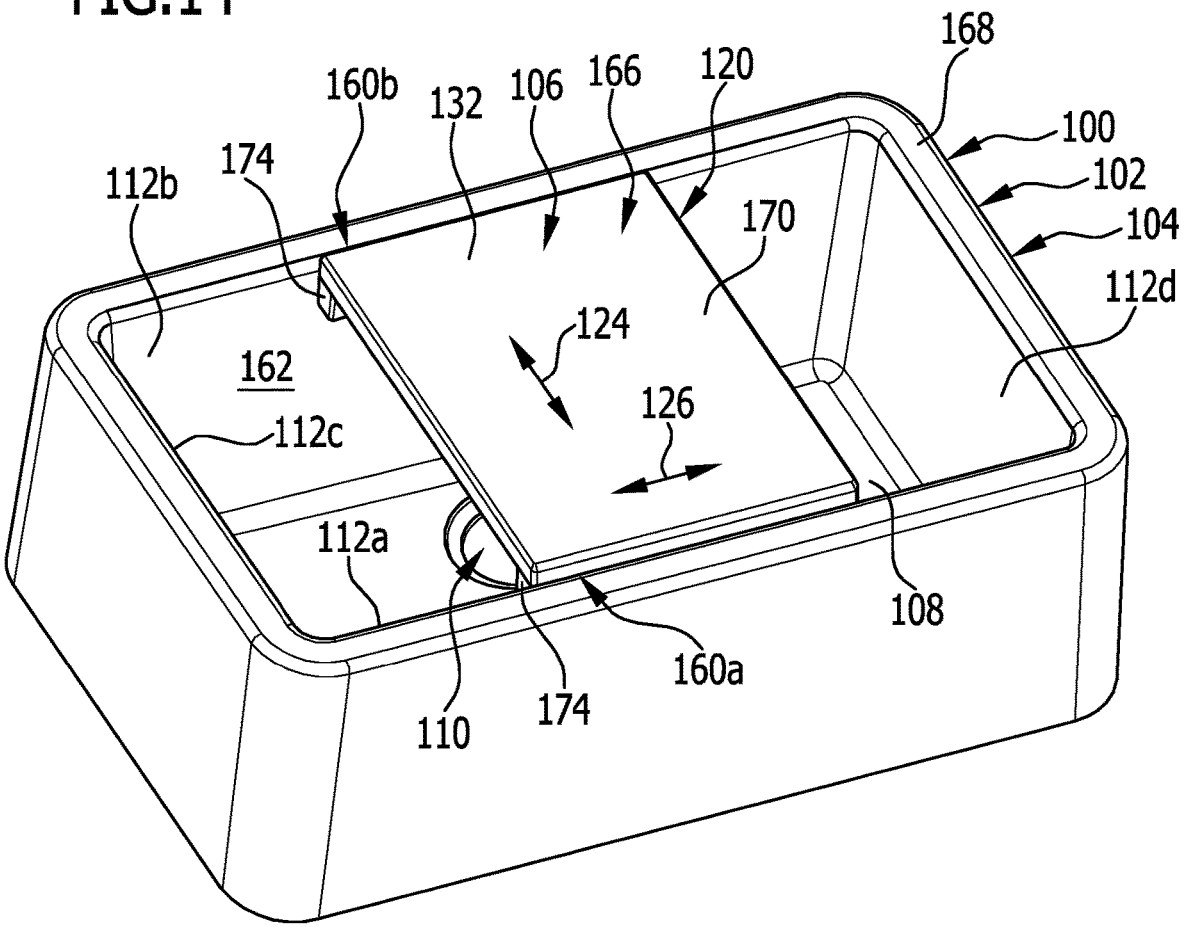
FIG. 14 shows a perspective illustration of a second embodiment of a sink having a bowl and a sink accessory part that is arranged on the bowl and is coupled by means of a first coupling device to a first side wall of the bowl and by means of a second coupling device to a second side wall of the bowl.
Figure 15:
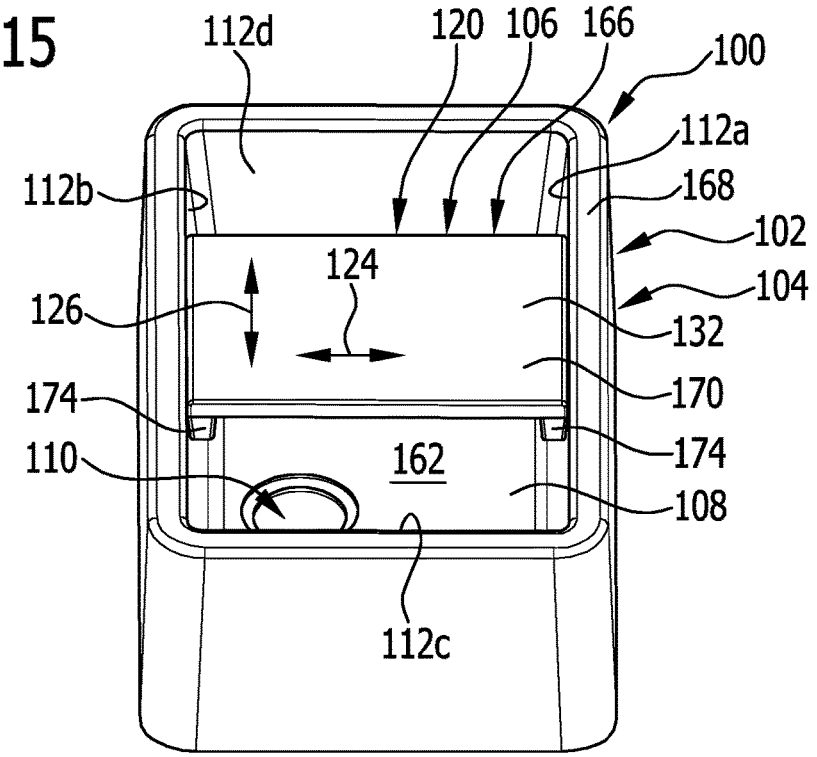
FIG. 15 shows a further perspective illustration of the combination comprising a sink and the sink accessory part in FIG. 14, with the direction of view parallel to the long sides of the bowl.
Figure 16:
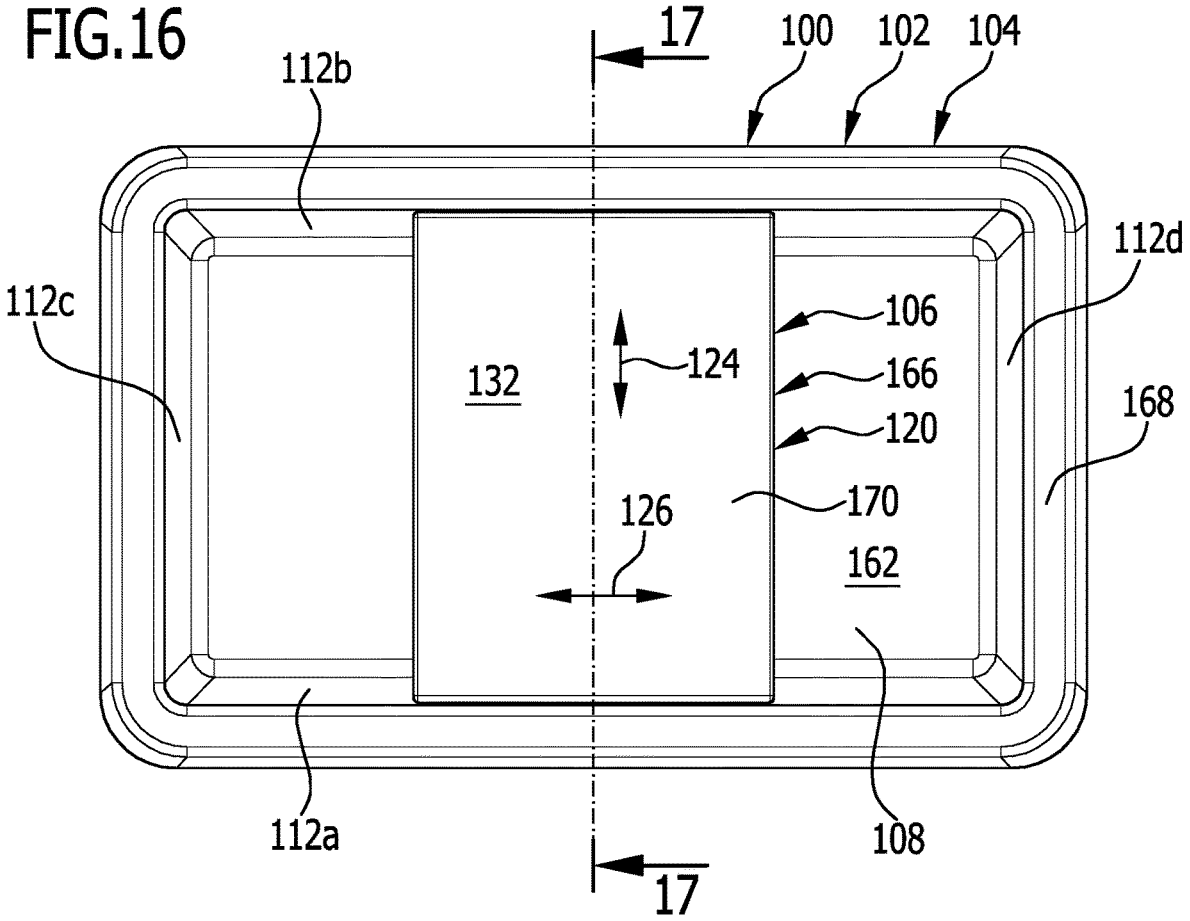
FIG. 16 shows a plan view from above of the combination comprising a sink and the sink accessory part in FIGS. 14 and 15.

As can best be seen from FIG. 8, each of the outer lower longitudinal carriers 138 includes at its two ends a respective end region 142 that is inclined with respect to the longitudinal direction 124 by an angle $\alpha$ of for example at least approximately 20°, in particular at least approximately 40°, preferably at least approximately 50°, and/or at most approximately 80°, preferably at most approximately 70°. The angle $\alpha$ may for example be approximately 60°.

The outer lower longitudinal carriers 138, the inner lower longitudinal carriers 136, the transverse carriers 128 and/or the upper longitudinal carriers 122 are preferably formed by a metal wire material and/or preferably have a substantially circular cross section.

The outer lower longitudinal carriers 138 and/or the inner lower longitudinal carriers 136 may be fixed to the transverse carriers 128 by a substance-to-substance bond, for example by adhesion, welding or soldering.

As an alternative thereto, the outer lower longitudinal carriers 138, the inner lower longitudinal carriers 136, the transverse carriers 128 and/or the upper longitudinal carriers 122 may also be made from a different material, for example a plastics material, and or may have any desired other cross section, for example a rectangular or square cross section.

The end regions 142 of the outer lower longitudinal carriers 138 each carry a coupling element 144, as illustrated individually in FIGS. 10 to 13.

The coupling element 144 includes a base 146 which is for example substantially frustoconical and is provided at an end face 148, preferably at the smaller end face, with a recess 150 that is formed in a manner complementing the end region 142, such that the end region 142 is at least partly received in the recess 150.

At its end remote from the end face 148, the base 146 carries a head region 152.

The head region 152 is preferably rounded in form and may in particular be substantially in the shape of a segment of a sphere.

The coupling element 144 comprising the base 146 and the head region 152 is preferably made in one piece.

The coupling element 144 is preferably made from a friction-enhancing material or has a coating made from a friction-enhancing material.

The coupling element 144 may be formed from a plastics material, in particular an elastomer material, for example a silicone material.

The coupling element 144 is preferably made separately from the base body 120 of the sink accessory part 106 and is fixed to the base body 120 later, in particular being fixed to a respectively associated end region 142 of one of the outer lower longitudinal carriers 138.

The coupling element 144 may be fixed to the base body 120 for example by press-fitting and/or adhesion.

As an alternative thereto, it may also be provided for the coupling element 144 to be produced on the base body 120 in situ, for example by a procedure of moulding on an injection mouldable material.

As can be seen for example from FIG. 8, each of the upper longitudinal carriers 122 of the sink accessory part 106 also has two respective end regions 154, which are connected to one another by a central region 156 that extends in the longitudinal direction 124 of the sink accessory part 106.

However, the end regions 154 of the upper longitudinal carriers 122 are preferably aligned parallel to the longitudinal direction 124 or inclined at an angle $\alpha'$ (not illustrated) with respect to the longitudinal direction 124 that is smaller than the angle $\alpha$ at which the end regions 142 of the outer lower longitudinal carriers 138 are inclined with respect to the longitudinal direction 124 and with respect to the support area 132 of the sink accessory part 106.

Each end region 154 of one of the upper longitudinal carriers 122 also engages in a respective recess 150 in a coupling element 144 that is arranged on the respective end region 154.

As can best be seen from FIG. 6, in this embodiment the sink accessory part 106 thus has a total of eight coupling elements 144, wherein in each case an upper coupling element 144*b* at an end region 154 of one of the two upper longitudinal carriers 122 and an adjacent lower coupling element 144*a* at an end region 142 of one of the outer lower longitudinal carriers 138 together form a coupling element pair 158.

The coupling elements 144 that are arranged at the front end regions 142, 154 together form a first coupling device 160*a* for coupling the sink accessory part 106 to the front first side wall 112*a* of the bowl 104 of the sink 102.

The coupling elements 144 that are arranged at the rear end regions 142, 154 together form a second coupling device 160*b* for coupling the sink accessory part 106 to the rear second side wall 112*b*, opposing the first side wall 112*a*, of the bowl 104 of the sink 102.

The sink accessory part 106 may, by means of the lower coupling elements 144*a* that are arranged at the end regions 142 of the outer lower longitudinal carriers 138, be supported on a supporting face that is preferably oriented substantially horizontally and/or is preferably substantially planar, for example on a worktop on which the sink 102 is arranged, on a drip surface (not illustrated) of the sink 102, or on a table top.

Here, the preferably friction-enhancing material of the coupling elements 144*a* prevents the sink accessory part 106 from moving undesirably in relation to the supporting face.

Further, the sink accessory part 106 may be put into the position that is illustrated in FIGS. 1 to 3, coupled to the side walls 112*a* and 112*b* of the bowl 104, in that the sink accessory part 106 is inserted into the bowl 104 from above until the coupling elements 144 of the first coupling device 160*a* abut against the first side wall 112*a* and the coupling elements 144 of the second coupling device 160*b* abut against the second side wall 112*b* of the bowl 104.

The region of the first side wall 112*a*, against which the coupling elements 144 of the first coupling device 160*a* abut, is preferably inclined to the vertical at a small acute angle β of preferably at least approximately 1°, in particular at least approximately 3°, particularly preferably at least approximately 6°, and/or preferably at most approximately 20°, in particular at most approximately 10°, particularly preferably at most approximately 8°.

The same applies to the region of the second side wall 112*b*, against which the coupling elements 144 of the second coupling device 160*b* abut.

The end regions 142, 154 of the sink accessory part 106 are preferably formed and arranged in relation to one another such that, when the lower coupling elements 144*a*, which are arranged at the end regions 142, and the upper coupling elements 144*b*, which are arranged at the end regions 154, are in the position coupled to the side walls 112*a*, 112*b* of the bowl 104, they all abut against the respectively associated side wall 112*a* or 112*b* at the same time.

In this coupled position of the sink accessory part 106, the lower coupling elements 144*a* are at a spacing from the base region 108 of the bowl 104, with the result that when the sink accessory part 106 is in the coupled position it is not in contact with the base region 108.

Further, in the coupled position the sink accessory part 106 is spaced from the bowl flange 114, with the result that when the sink accessory part 106 is in the coupled position it is not in contact with the bowl flange 144 or with another edge region of the sink 102 that adjoins the side walls 112*a*, 112*b* of the bowl 104 or a worktop that adjoins the sink 102.

As can be seen from FIG. 3, in this embodiment, when the sink accessory part 106 is in its position coupled to the side walls 112*a*, 112*b* of the bowl 104, it is entirely received in an interior 162 of the bowl 104, with the result that no part of the sink accessory part 106 projects upwards outside the bowl 104 beyond the side walls 112*a*, 112*b* of the bowl 104.

When the sink accessory part 106 is in the position coupled to the bowl 104, it is clamped between the first side wall 112*a* and the second side wall 112*b* and is fixedly immobilised or fixed to the side walls 112*a*, 112*b* both by positive locking and by force locking of the coupling elements 144.

Since the spacing between the first side wall 112*a* and the second side wall 112*b* lessens in the region that is below the sink accessory part 106 in the coupled position thereof, the sink accessory part 106 cannot be moved further down, out of its coupled position, towards the base region 108 of the bowl 104.

As a result of the force locking between the coupling elements 144 and the side walls 112*a*, 112*b*, the sink accessory part 106, once it is coupled to the side walls 112*a*, 112*b*, can moreover no longer be moved horizontally, in its transverse direction 126 in relation to the bowl 104.

Thus, reliable and stable immobilisation of the sink accessory part 106 in its coupled position in the bowl 104 of the sink 102 is ensured.

In order to remove the sink accessory part 106 from its position coupled to the bowl 104, a retaining force must be overcome.

Using an upwardly directed force, and with the assistance of a slight elastic deformation of the coupling elements 144 and/or the bowl 104, the sink accessory part 106 can be removed again from its position coupled to the bowl 104.

In the embodiment illustrated in FIGS. 1 to 3, the extent of the sink accessory part 106 in its longitudinal direction 124 is longer than the extent of the sink accessory part 106 in its transverse direction 126.

By contrast, the spacing between the front first side wall 112*a* and the rear second side wall 112*b* is smaller than the spacing between the left-hand side wall 112*c* and the right-hand side wall 112*d*.

Thus, if the coupling device 106 is put into the bowl 104 in a position in which the longitudinal direction 124 of the sink accessory part 106 is not aligned parallel to the left-hand side wall 112*c* and the right-hand side wall 112*d* but substantially parallel to the first side wall 112*a* and the second side wall 112*b*, the sink accessory part 106 can be lowered as far as the base region 108 of the bowl 104.

Preferably, in that case the sink accessory part 106 is supported with the lower coupling elements 144*a* against the base region 108 of the bowl 104.

In FIGS. 1 to 3, the sink accessory part 106 is illustrated in a position coupled to the bowl 104 in which the sink accessory part 106 is arranged substantially centrally on the bowl 104.

However, it is entirely possible, as an alternative thereto, to couple the sink accessory part 106 to the side walls 112*a*, 112*b* in other positions, in which the sink accessory part 106 is displaced along the side walls 112*a*, 112*b* in relation to the position illustrated in FIGS. 1 to 3, in that the sink accessory part 106 is inserted into the bowl 104 at a smaller spacing or a larger spacing from the left-hand side wall 112*c*. In so doing, however, the height at which the sink accessory part 106 is located in these different positions coupled to the bowl 104 remains substantially unchanged.

A second embodiment, illustrated in FIGS. 14 to 29, of a combination 100 includes a sink 102 having a bowl 104 and a sink accessory part 106, wherein the latter is arrangeable on the bowl 104 and in this embodiment takes the form of a cutting board 166.

Figure 18:
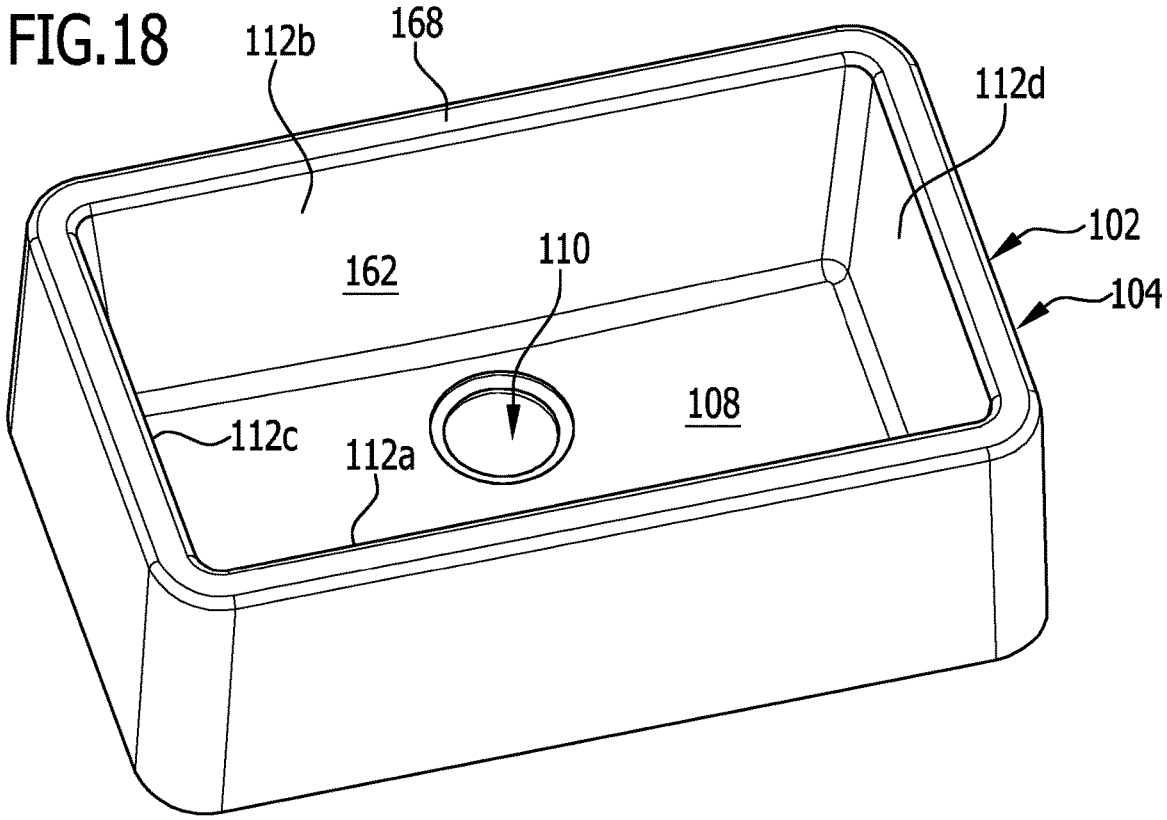
FIG. 18 shows a perspective illustration of the sink in FIG. 14, without the sink accessory part.
Figure 19:
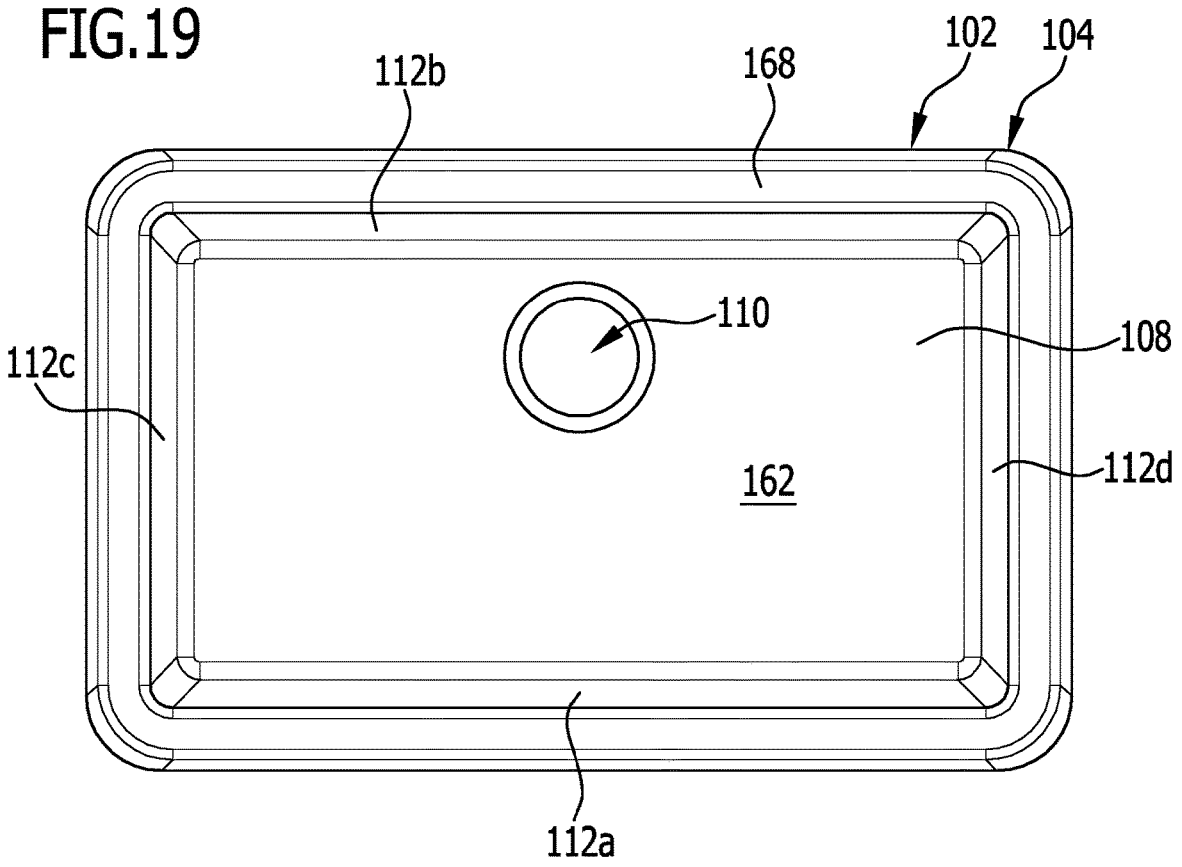
FIG. 19 shows a plan view from above of the sink in FIG. 18.
Figure 20:
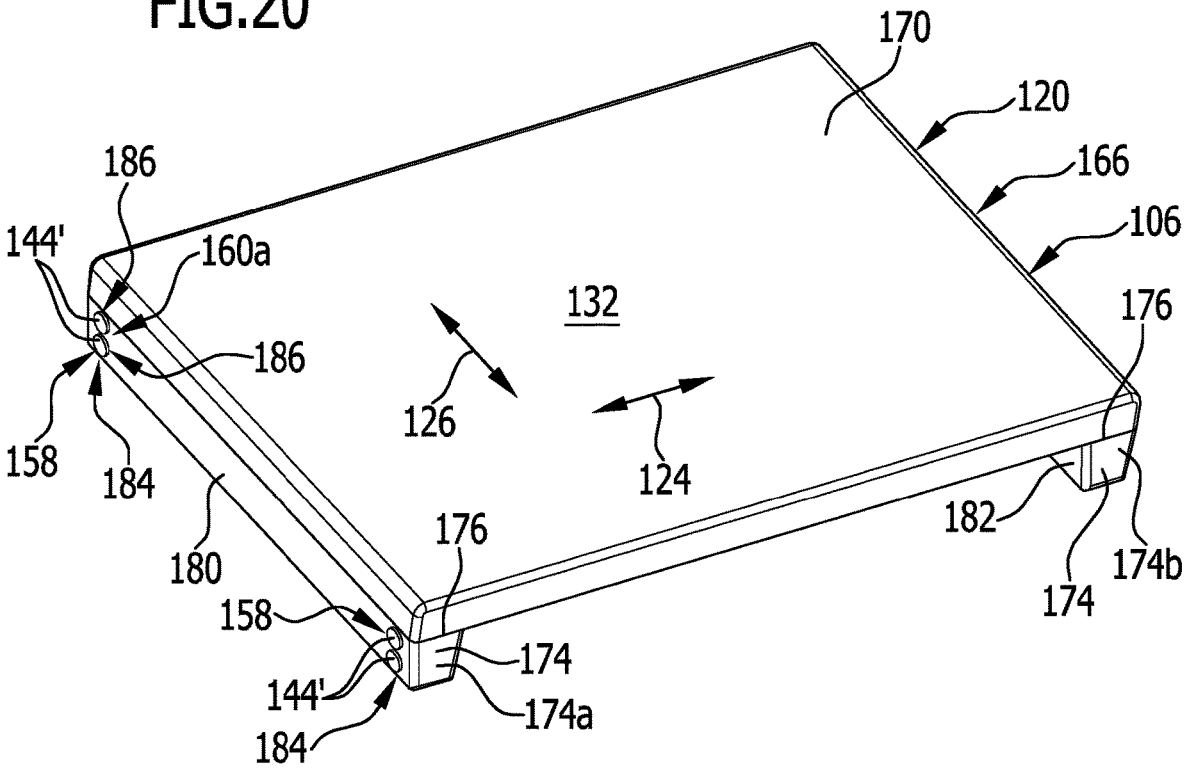
FIG. 20 shows a perspective illustration of the sink accessory part in FIGS. 14 to 17, with a view of an upper side of the sink accessory part.

The bowl 104 that is illustrated individually in FIGS. 18 and 19 includes a base region 108, in which there is provided a bowl drainage opening 110, and side walls 112 that extend almost vertically upwards from the base region 108, in particular a front first side wall 112*a*, a rear second side wall 112*b*, a left-hand side wall 112*c* and a right-hand side wall 112*d*, wherein the left-hand side wall 112*c* and the right-hand side wall 112*d* connect the first side wall 112*a* and the side wall 112*b* to one another.

Further, the bowl 104 includes a bowl edge 168 that runs peripherally along the upper edges of the side walls 112 and is oriented substantially horizontally.

The bowl 104 is preferably made in one piece.

The bowl 104 may in principle be formed from any desired material, for example a stainless steel material, a ceramic material, a plastics material or a composite material.

The sink 102 may include, besides the at least one bowl 104, other bowls and/or a drip surface.

The sink accessory part 106, which is illustrated individually in FIGS. 20 to 29, and which takes the form of a cutting board 166, includes a base body 120 having a base plate 170—preferably substantially cuboid—whereof the upper side forms a support area 132 of the sink accessory part 106.

Arranged on an underside 172 of the base plate 170 that is remote from the support area 132 (see in particular FIGS. 21 and 23) are two foot strips 174 that extend in a transverse direction 126 of the sink accessory part 106 and are spaced from one another in a longitudinal direction 124 of the sink accessory part 106 that runs perpendicular to the transverse direction 126.

In particular, the two foot strips 174 each run along an outer edge of the base plate 170, preferably in each case along a short side of the base plate 170.

The base plate 170 and the foot strips 174 may for example be formed from a wood material or a plastics material.

The foot strips 174 may for example be fixed to the base plate 170 by means of dowels and/or adhesion.

Figure 24:
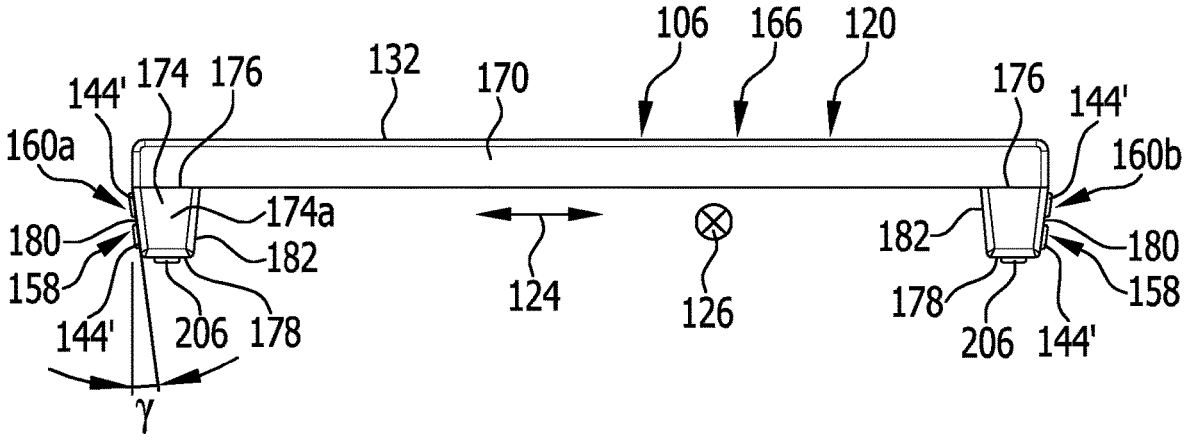
FIG. 24 shows a front view of the sink accessory part in FIGS. 20 to 23, with the direction of view in the direction of the arrow 24 in FIG. 22.
Figure 25:
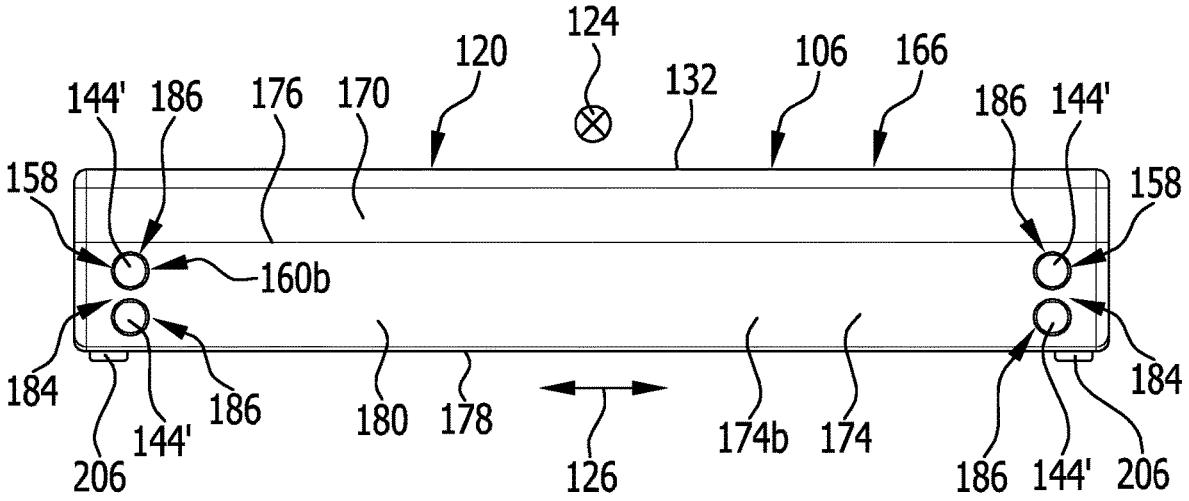
FIG. 25 shows a side view of the sink accessory part in FIGS. 20 to 24, with the direction of view in the direction of the arrow 25 in FIG. 22.
Figure 26:
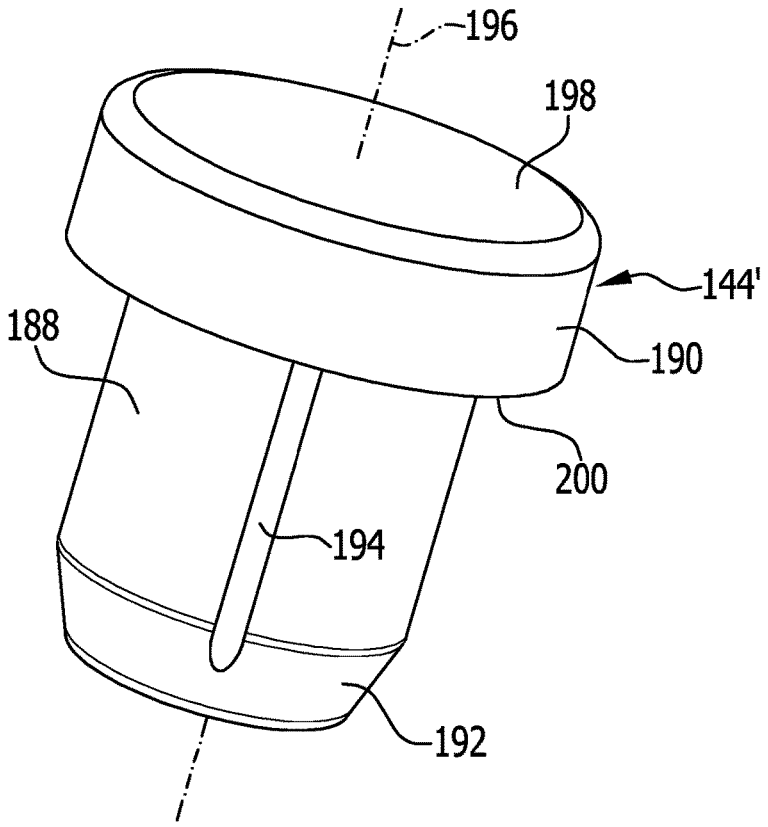
FIG. 26 shows a perspective illustration of a coupling element of a coupling device of the sink accessory part in FIGS. 20 to 25.

As can best be seen from FIG. 24, each foot strip 174 may have a substantially trapezoidal cross section that tapers from an upper side 176 of the foot strip 174 facing the base plate 170 towards an underside 178 of the respective foot strip 174 remote from the base plate 170.

The upper side 176 and the underside 178 of each foot strip 174 are connected to one another by, respectively, an outer side face 180 and an inner side face 182.

If the support area 132 of the sink accessory part 106 is oriented horizontally, the outer side face 180 of each foot strip 174 is inclined by an angle $\alpha$ to the vertical, wherein the angle $\alpha$ preferably corresponds substantially to the angle $\beta$ about which the first side wall 112*a* and the second side wall 112*b* of the bowl 104 are inclined to the vertical in the installed condition of the sink 102.

Preferably, the angle $\beta$ and/or the angle $\alpha$ are in this case at least approximately 1°, in particular at least approximately 3°, particularly preferably at least approximately 6°, and/or preferably at most approximately 20°, in particular at most approximately 10°, particularly preferably at most approximately 8°.

At the end regions 184 of the outer side faces 180 of the foot strips 174 there are provided in each case one or more, in particular two, recesses 186 in which in each case a coupling element 144' may be partly received.

If a plurality of recesses 186 and coupling elements 144' are provided in an end region 184, these are preferably arranged at different spacings from the support area 132 of the sink accessory part 106.

A coupling element 144' of this kind is illustrated individually in FIGS. 26 to 29.

The coupling element 144' includes a substantially cylindrical shaft 188 that carries a likewise substantially cylindrical head 190, which has a larger external diameter than the shaft 188.

The end region of the shaft 188 remote from the head 190 is provided with a chamfer 192.

Figure 27:
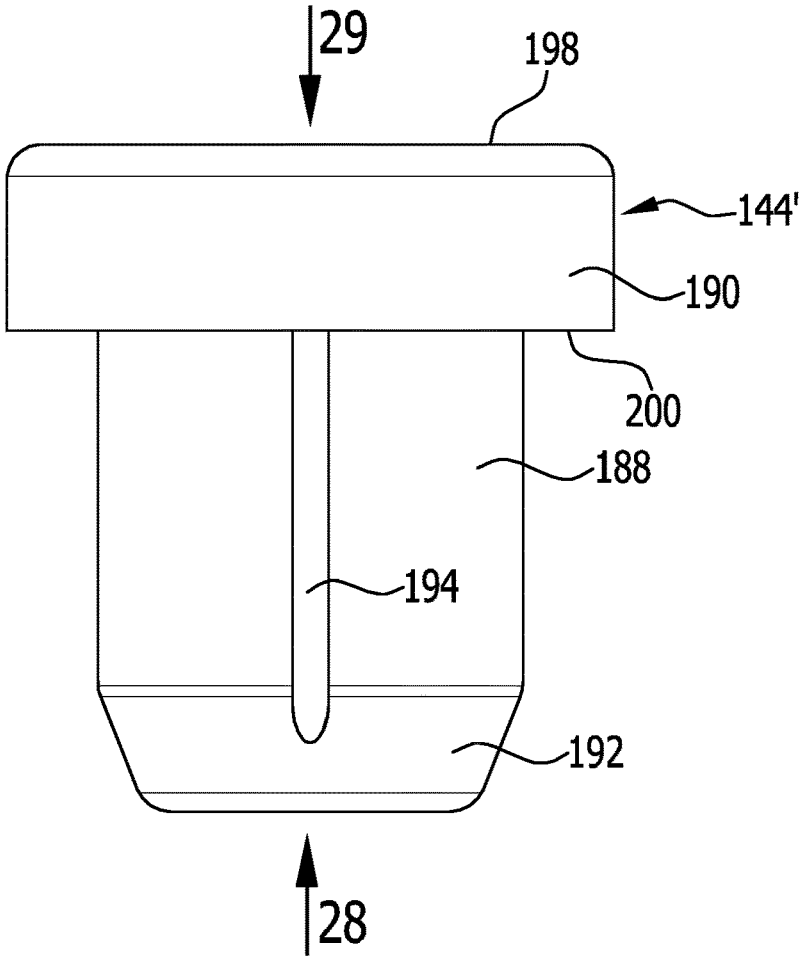
FIG. 27 shows a side view of the coupling element in FIG. 26.
Figure 28:
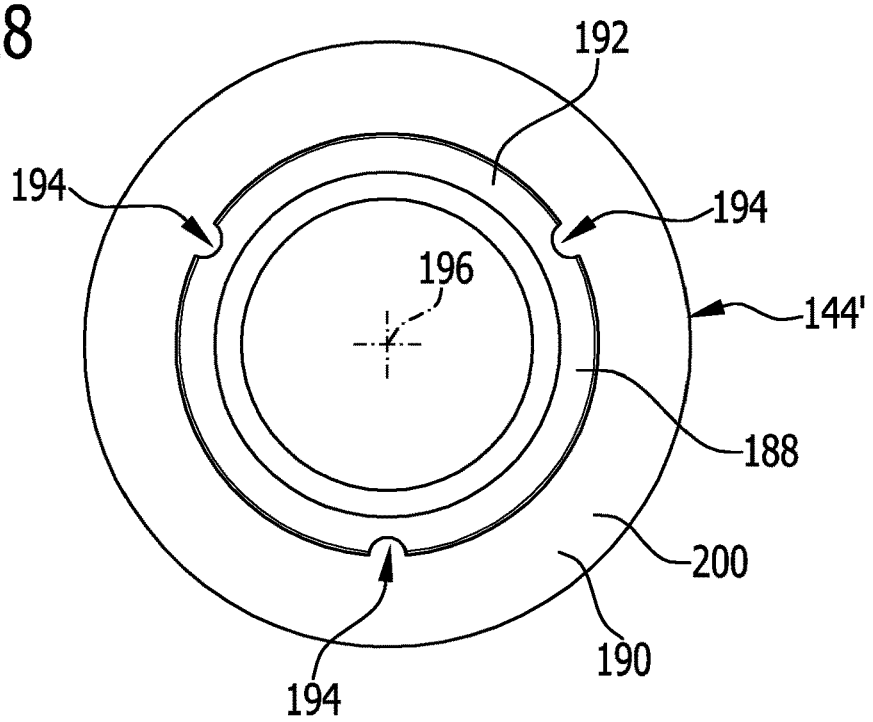
FIG. 28 shows a plan view from below of the coupling element in FIGS. 26 and 27, with the direction of view in the direction of the arrow 28 in FIG. 27.
Figure 29:
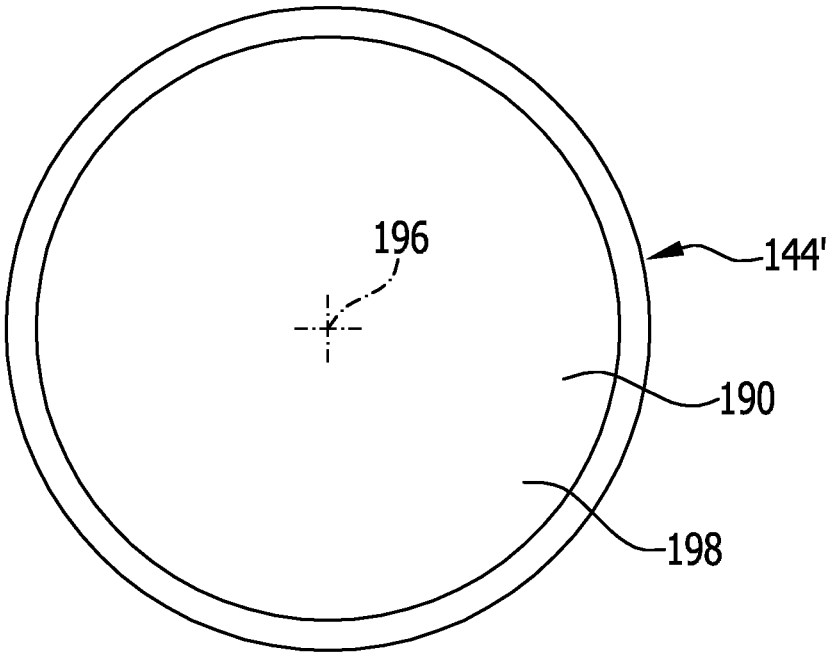
FIG. 29 shows a plan view from above of the coupling element in FIGS. 26 to 28, with the direction of view in the direction of the arrow 29 in FIG. 27.

As can best be seen from FIGS. 27 and 28, a plurality of grooves 194, for example three grooves 194, extend from an end region of the shaft 188 facing the head 190, parallel to the longitudinal centre axis 196 of the coupling element 144', and into the region of the chamfer 192.

The grooves 194 are preferably distributed substantially equidistantly around the longitudinal centre axis 196 of the coupling element 144' in the peripheral direction of the shaft 188.

The head 190 of the coupling element 144' has an end face 198 that is remote from the shaft 188 and whereof the outer edge may be rounded.

The coupling element 144' comprising the shaft 188 and the head 190 is preferably made in one piece.

The coupling element 144' is preferably made from a friction-enhancing material.

The coupling element 144' may be formed from a plastics material, in particular an elastomer material, for example a silicone material.

The coupling element 144' is preferably made separately from the base body 120 of the sink accessory part 106, wherein in this embodiment the base body 120 includes the base plate 170 and the two foot strips 174, and is fixed to the base body 120 later, wherein the shaft 188 of the coupling element 144' is received in the respectively associated recess 186 in one of the end regions 184 of the outer side faces 180 of the foot strips 174, and the head 190 of the respective coupling element 144' projects beyond the respective recess 186.

Here, an underside 200 of the head 190 of the coupling element 144', which projects beyond the shaft 188 in the radial direction of the longitudinal centre axis 196 of the coupling element 144', preferably abuts against the region of the respective outer side face 180 that surrounds the recess 186.

The coupling element 144' may be fixed to the base body 120 for example by press-fitting and/or adhesion.

As an alternative thereto, it may also be provided for the coupling element 144' to be produced on the base body 120 in situ, for example by a procedure of moulding on an injection mouldable material.

Figure 21:
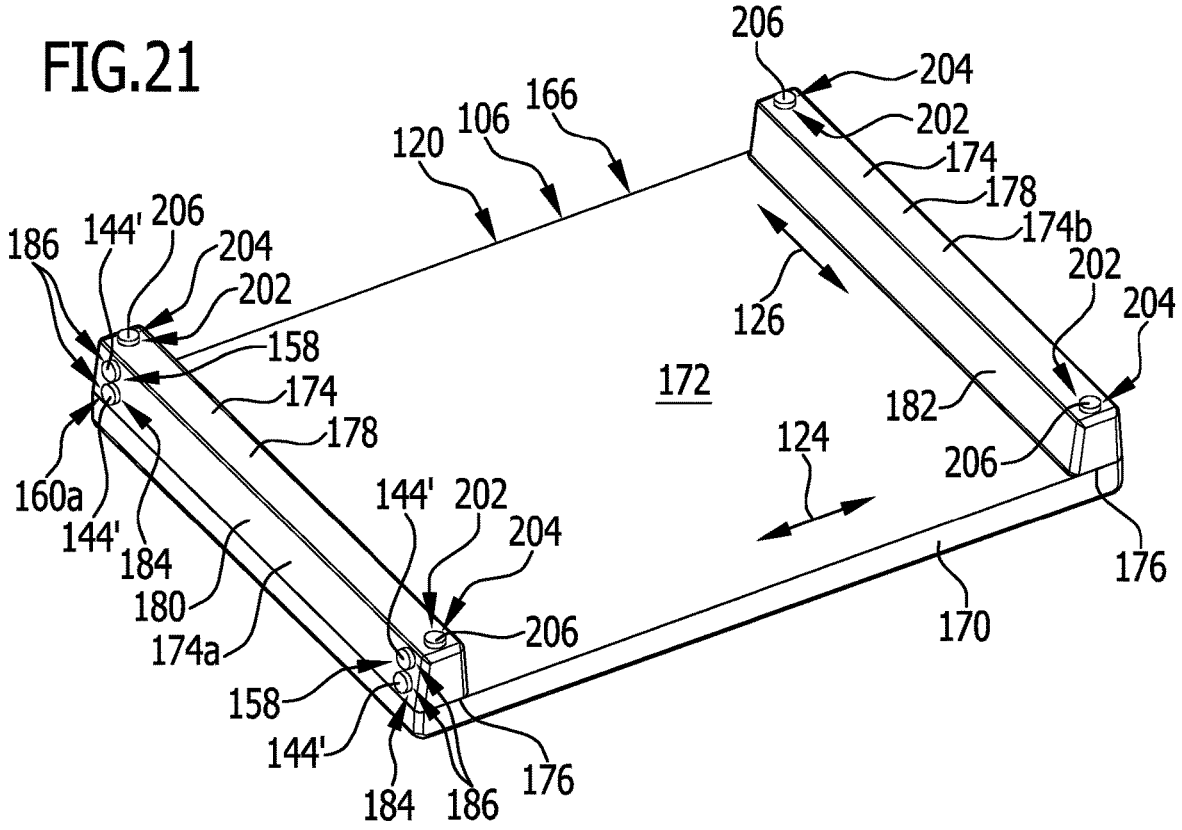
FIG. 21 shows a perspective illustration of the sink accessory part in FIG. 20, with a view of an underside of the sink accessory part.
Figure 22:
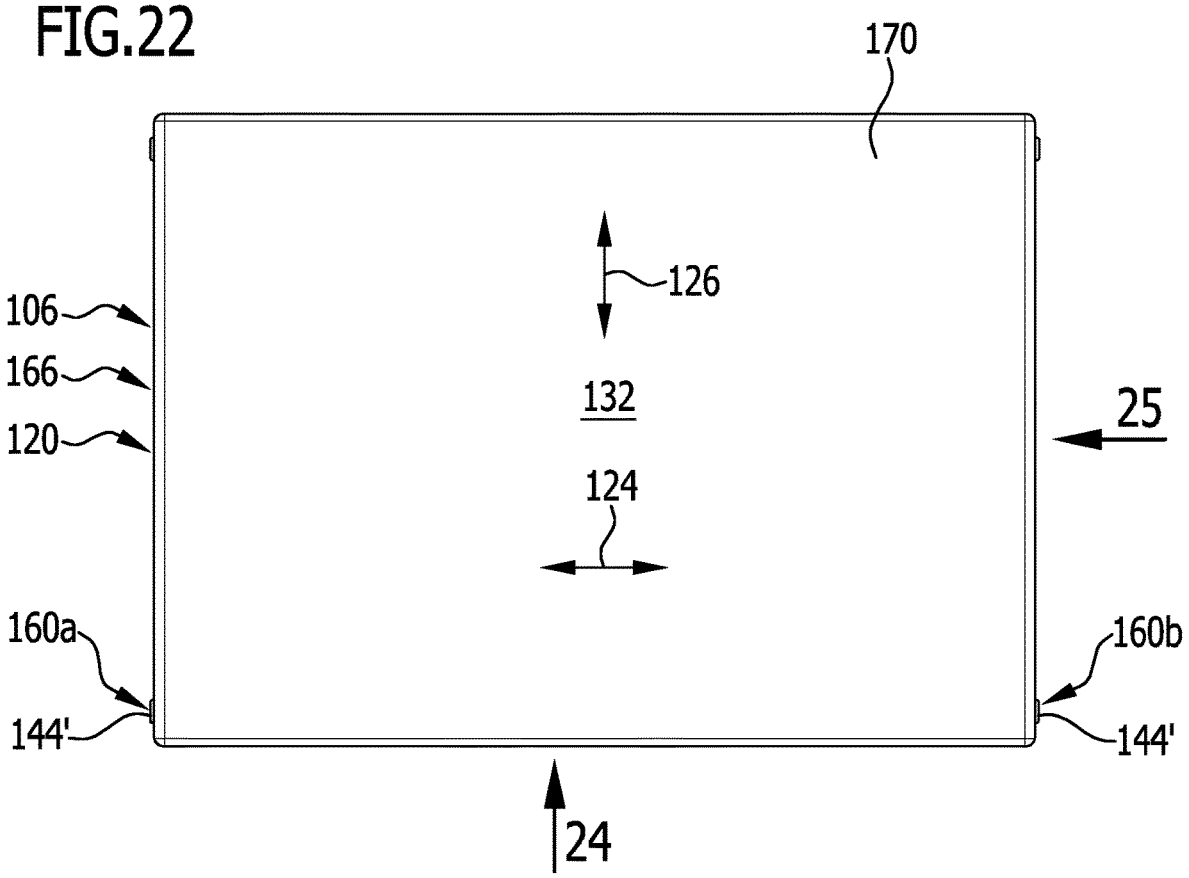
FIG. 22 shows a plan view from above of the sink accessory part in FIGS. 20 and 21.
Figure 23:
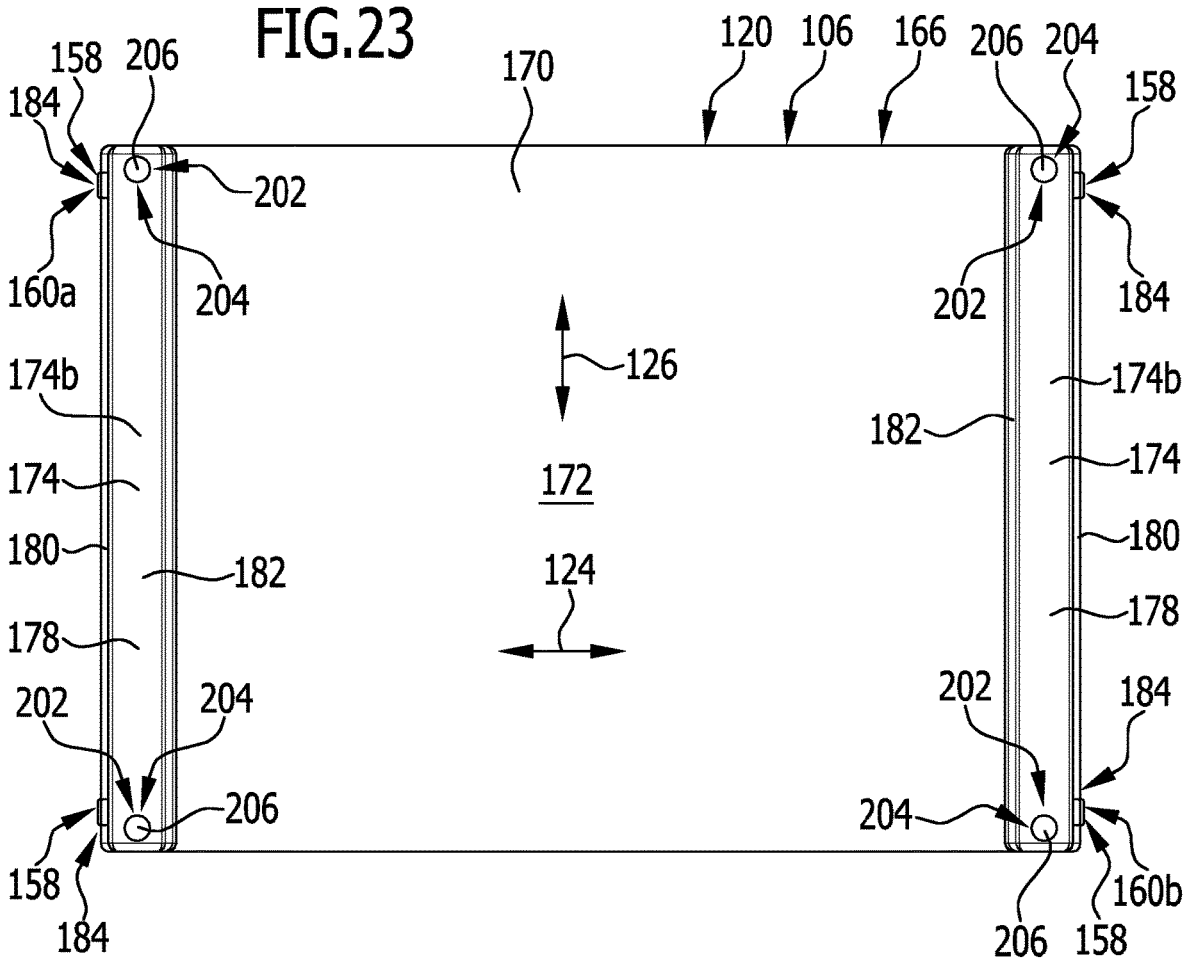
FIG. 23 shows a plan view from below of the sink accessory part in FIGS. 20 to 22.

As can be seen for example from FIGS. 21 and 23, the end regions 202 of the undersides 178 of the foot strips 174 of the sink accessory part 106 are also provided with in each case at least one recess 204, in each of which a support element 206 is at least partly received.

Each of the support elements 206 may in particular take the same form as one of the coupling elements 144', as illustrated in FIGS. 26 to 29 and described above.

As a result of the identical form of the support elements 206 and the coupling elements 144', the number of different parts required to manufacture the sink accessory part 106 is reduced and so manufacture of the sink accessory part 106 is simplified.

By means of the support elements 206, of which there are for example four, the sink accessory part 106 may be supported on a supporting face which is preferably oriented substantially horizontally and/or is preferably substantially planar, for example on a worktop on which the sink 102 is arranged, on a drip surface (not illustrated) of the sink 102 or on a table top.

Here, the preferably friction-enhancing material of the support elements 206 prevents the sink accessory part 106 from moving undesirably in relation to the supporting face.

In this embodiment, the sink accessory part 106 has a total of eight coupling elements 144', wherein in each case two coupling elements 144' at the same end region 184 of the same outer side face 180 of a foot strip 174 together form a coupling element pair 158.

The coupling elements 144' that are arranged at the front foot strip 174*a* together form a first coupling device 160*a* for coupling the sink accessory part 106 to the front first side wall 112*a* of the bowl 104 of the sink 102.

The coupling elements 144' that are arranged at the rear foot strip 174*b* together form a second coupling device 160*b* for coupling the sink accessory part 106 to the rear second side wall 112*b*, opposing the first side wall 112*a*, of the bowl 104 of the sink 102.

The sink accessory part 106 may be put into the position that is illustrated in FIGS. 14 to 17, coupled to the side walls 112*a* and 112*b* of the bowl 104, in that the sink accessory part 106 is partly inserted into the bowl 104 from above until the coupling elements 144' of the first coupling device 160*a* abut against the first side wall 112*a* and the coupling elements 144' of the second coupling device 160*b* abut against the second side wall 112*b* of the bowl 104.

Here, the coupling elements 144' of a coupling element pair 158, which are arranged at different spacings from the support area 132 of the sink accessory part 106, in the position in which the sink accessory part 106 is coupled to the side walls 112*a*, 112*b* of the bowl 104, preferably abut against the respectively associated side wall 112*a* or 112*b* at the same time.

In this coupled position of the sink accessory part 106, the support elements 206 are at a spacing from the base region 108 of the bowl 104, with the result that when the sink accessory part 106 is in the coupled position it is not in contact with the base region 108.

Further, in the coupled position the sink accessory part 106 is not in contact with the bowl edge 168 of the bowl 104 or in contact with another edge region of the sink 102 that adjoins the side walls 112*a*, 112*b* of the bowl 104, or a worktop that adjoins the sink 102.

Figure 17:
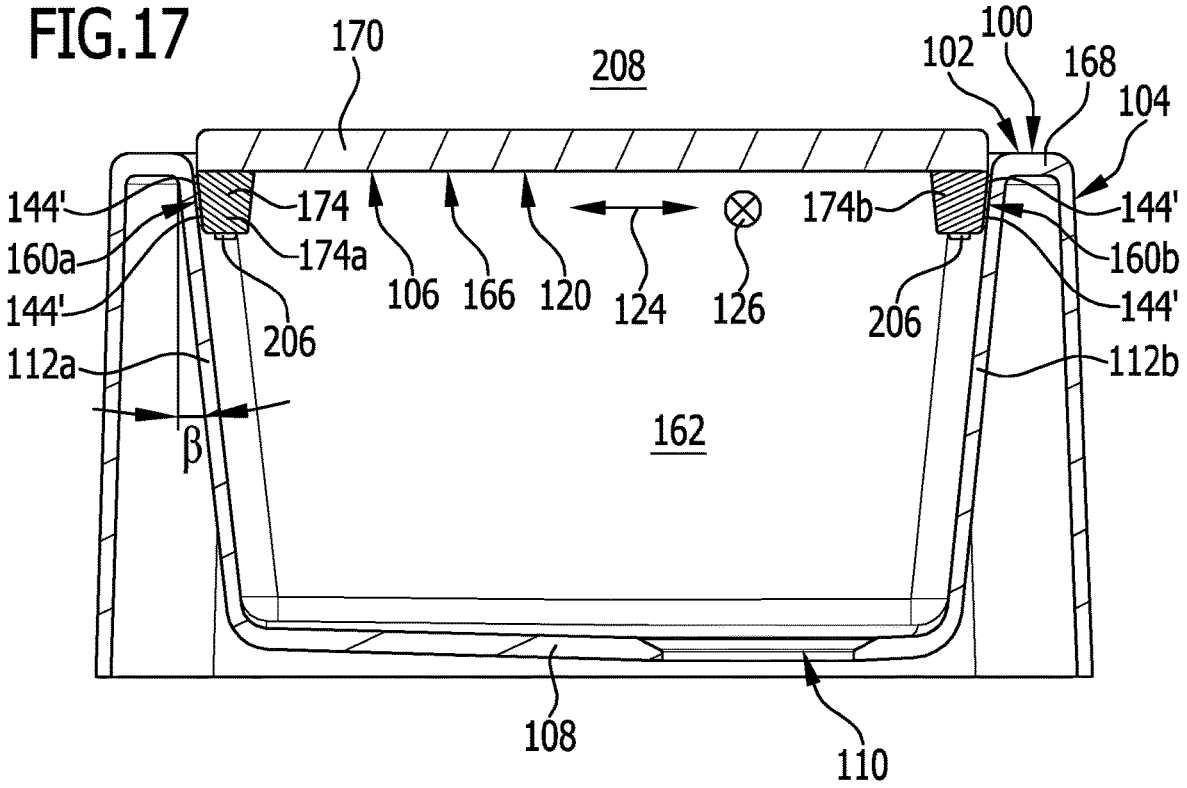
FIG. 17 shows a vertical section through the combination comprising a sink and the sink accessory part in FIGS. 14 to 16, along the line 17-17 in FIG. 16.

As can be seen from FIG. 17, in this embodiment, when the sink accessory part 106 is in its position coupled to the side walls 112*a*, 112*b* of the bowl 104, it is only partly received in an interior 162 of the bowl 104.

Here, the foot strips 174 of the sink accessory part 106 with the coupling devices 160*a* and 160*b* arranged thereon are in the coupled position in the interior 162 of the bowl 104, while at least part of the base plate 170 of the sink accessory part 106 projects upwards into an external space 208 outside the bowl 104, beyond the upper edges of the side walls 112*a*, 112*b*.

In the position coupled to the bowl 104, the sink accessory part 106 is fixedly immobilised or fixed between the first side wall 112*a* and the second side wall 112*b* both by positive locking and by force locking of the coupling elements 144' to the side walls 112*a*, 112*b*.

Since the spacing between the first side wall 112*a* and the second side wall 112*b* lessens in the region that is below the sink accessory part 106 in the coupled position thereof, the sink accessory part 106 cannot be moved further down, out of its coupled position, towards the base region 108 of the bowl 104.

As a result of the force locking between the coupling elements 144' and the side walls 112*a*, 112*b*, the sink accessory part 106, once it is coupled to the side walls 112*a*, 112*b*, can moreover no longer be moved horizontally, in its transverse direction 126 in relation to the bowl 104.

Thus, reliable and stable immobilisation of the sink accessory part 106 in its coupled position in the bowl 104 of the sink 102 is ensured.

In order to remove the sink accessory part 106 from its position coupled to the bowl 104, a retaining force must be overcome.

Using an upwardly directed force, and with the assistance of a slight elastic deformation of the coupling elements 144' and/or the bowl 104, the sink accessory part 106 can be removed again from its position coupled to the bowl 104.

In the embodiment illustrated in FIGS. 14 to 17, the extent of the sink accessory part 106 in its longitudinal direction 124 is longer than the extent of the sink accessory part 106 in its transverse direction 126.

By contrast, the spacing between the front first side wall 112*a* and the rear second side wall 112*b* is smaller than the spacing between the left-hand side wall 112*c* and the right-hand side wall 112*d*.

Thus, if the coupling device 106 is put into the bowl 104 in a position in which the longitudinal direction 124 of the sink accessory part 106 is not aligned parallel to the left-hand side wall 112*c* and the right-hand side wall 112*d* but substantially parallel to the first side wall 112*a* and the second side wall 112*b*, the sink accessory part 106 can be lowered as far as the base region 108 of the bowl 104.

Preferably, in that case the sink accessory part 106 is supported with the support elements 206 against the base region 108 of the bowl 104.

In FIGS. 14 to 17, the sink accessory part 106 is illustrated in a position coupled to the bowl 104 in which the sink accessory part 106 is arranged substantially centrally on the bowl 104.

However, it is entirely possible, as an alternative thereto, to couple the sink accessory part 106 to the side walls 112*a*, 112*b* in other positions, in which the sink accessory part 106 is displaced along the side walls 112*a*, 112*b* in relation to the central position illustrated in FIGS. 14 to 17, in that the sink accessory part 106 is brought up to the bowl 104 at a smaller spacing or a larger spacing from the left-hand side wall 112*c*.

In so doing, however, the height at which the sink accessory part 106 is located in these different positions coupled to the bowl 104 remains substantially unchanged.

The invention claimed is:

1. A sink accessory part for arrangement on a sink,
the sink accessory part comprising:
- a base body;
- a first coupling device including a first coupling element that is fixed to the base body, the first coupling device for frictionally coupling the sink accessory part to a first side wall of a bowl of the sink;
- a second coupling device including a second coupling element that is fixed to the base body, the second coupling device for frictionally coupling the sink accessory part to a second side wall, opposing the first side wall, of the bowl of the sink;
- wherein, when the first and second coupling elements are frictionally engaged to the respectively associated side walls of the bowl, the first coupling device, the second coupling device, and the sink accessory part cannot be moved horizontally.

2. A sink accessory part according to claim 1, wherein the first coupling device and/or the second coupling device are couplable by positive locking and/or by force locking to the respectively associated side wall of the bowl.

3. A sink accessory part according to claim 1, wherein the first coupling device and/or the second coupling device each include at least two mutually spaced coupling elements for coupling the sink accessory part to the respectively associated side wall of the bowl.

4. A sink accessory part according to claim 3, wherein the at least two mutually spaced coupling elements of the first coupling device are arranged on the sink accessory part at different heights and/or the at least two mutually spaced coupling elements of the second coupling device are arranged on the sink accessory part at different heights.

5. A sink accessory part according to claim 1, wherein the at least one coupling element includes a friction-enhancing material.

6. A sink accessory part according to claim 1, wherein the at least one coupling element surrounds an end of a carrier element of the base body of the sink accessory part.

7. A sink accessory part according to claim 1, wherein the at least one coupling element is at least partly received in a recess in the base body of the sink accessory part.

8. A sink accessory part according to claim 1, wherein the sink accessory part includes at least one support element for supporting the sink accessory part on a horizontal supporting face.

9. A sink accessory part according to claim 1, wherein the sink accessory part takes the form of a drip element or a grille.

10. A combination comprising:

a sink having at least one bowl, the sink including a first side wall and a second side wall opposing the first side wall; and a sink accessory part for arrangement on the sink, said sink accessory part comprising:

a base body;

a first coupling device including a first coupling element that is fixed to the base body of the sink accessory part, the first coupling element for frictionally coupling the sink accessory part to the first side wall of a bowl of the sink; and a second coupling device including a second coupling element that is fixed to the base body of the sink accessory part, the second coupling element for frictionally coupling the sink accessory part to the second side wall;

wherein, when the first and second coupling elements are frictionally engaged with the respectively associated side walls of the bowl, the sink accessory part including the first and second coupling devices is arranged immovably on the bowl, but can be removed from its position coupled to the bowl by using an upwardly directed force.

11. A combination according to claim 10, wherein the sink accessory part, when it is in a position coupled to the side walls of the bowl, is not in contact with a bowl flange or a bowl edge of the sink that adjoins the first side wall or the second side wall of the bowl.

12. A combination according to claim 10, wherein the sink accessory part, when it is in a position coupled to the side walls of the bowl, is not in contact with a base of the bowl of the sink.

13. A combination according to claim 10, wherein the sink accessory part, when it is in a position coupled to the side walls of the bowl, is secured in a manner preventing any movement in relation to the bowl in any horizontal direction parallel to the first side wall and/or the second side wall.

14. A combination according to claim 10, wherein the first side wall of the bowl and/or the second side wall of the bowl is inclined to the vertical in the installed condition of the sink.

15. A sink accessory part according to claim 1, wherein the sink accessory part takes the form of a cutting board or a basin.

16. A combination comprising:

a sink having at least one bowl having a first side wall including a first portion having an inclination to the vertical of at most 20° and a second side wall opposing the first side wall, wherein the second side wall includes a second portion having an inclination to the vertical of at most 20°; and a sink accessory part for arrangement on the sink, the sink accessory part comprising:

a base body;

a first coupling device including a first coupling element that is fixed to the base body, wherein the first coupling element includes a friction-enhancing material and wherein coupling element is for frictionally coupling the sink accessory part to the first portion having the inclination to the vertical of at most 20°; and a second coupling device including a second coupling element that is fixed to the base body, wherein the second coupling element includes the friction-enhancing material and wherein the second coupling element is for frictionally coupling the sink accessory part to the second portion having the inclination to the vertical of at most 20°.

17. A combination comprising:

a sink having at least one bowl including a first side wall and a second side wall, opposing the first side wall; and a sink accessory part for arrangement on the sink, said sink accessory part comprising:

a base body;

a first coupling device, for coupling the sink accessory part to the first side wall, the first coupling device including a first coupling element that is fixed to the base body; and a second coupling device, for coupling the sink accessory part to the second side wall, the second coupling device including a second coupling element that is fixed to the base body, wherein the sink accessory part including the first and second coupling devices, when it is in a position coupled to the side walls of the bowl, is secured in a manner preventing any movement in relation to the bowl in any horizontal direction parallel to the first side wall and the second side wall.

18. A combination according to claim 10, wherein the sink accessory part is clamped between the first side wall of the bowl and the second side wall of the bowl, at a working height that is predetermined by a dimension of the sink accessory part in a longitudinal direction thereof.

19. A combination according to claim 16, wherein the sink accessory part is clamped between the first side wall of the bowl and the second side wall of the bowl, at a working height that is predetermined by a dimension of the sink accessory part in a longitudinal direction thereof.

20. A combination according to claim 17, wherein the sink accessory part is clamped between the first side wall of the bowl and the second side wall of the bowl, at a working height that is predetermined by a dimension of the sink accessory part in a longitudinal direction thereof.

* * * * *